US005632057A

United States Patent [19]

Lyden

[11] Patent Number: 5,632,057

[45] Date of Patent: May 27, 1997

[54] METHOD OF MAKING LIGHT CURE COMPONENT FOR ARTICLES OF FOOTWEAR

[76] Inventor: Robert M. Lyden, 16384 SW. Estuary Dr., Apt. #203, Beaverton, Oreg. 97006

[21] Appl. No.: 510,433

[22] Filed: Aug. 2, 1995

Related U.S. Application Data

[63] Continuation of Ser. No. 275,642, Jul. 14, 1994, abandoned, which is a continuation of Ser. No. 74,771, Jun. 9, 1993, abandoned, which is a continuation-in-part of Ser. No. 976,407, Nov. 13, 1992, abandoned, which is a division of Ser. No. 805,596, Dec. 11, 1991, Pat. No. 5,203,793, which is a continuation-in-part of Ser. No. 714,971, Jun. 13, 1991, Pat. No. 5,101,580, which is a continuation of Ser. No. 410,074, Sep. 20, 1989, abandoned.

[51] Int. Cl.[6] ..... A43D 1/00; A43B 7/14

[52] U.S. Cl. ..... 12/146 B; 12/146 M; 36/93

[58] Field of Search ..... 12/146 B, 146 M; 36/93, 88, 89, 90, 92

[56] References Cited

U.S. PATENT DOCUMENTS

| | | | |
|---|---|---|---|
| 2,092,910 | 9/1937 | Daniels | 36/71 |
| 2,546,827 | 3/1951 | Lavinthal | 36/71 |
| 3,449,844 | 6/1969 | Spence | 36/44 |
| 3,786,580 | 1/1974 | Dalebout | 36/119 |
| 3,905,376 | 9/1975 | Johnson et al. | 36/154 |
| 4,139,337 | 2/1979 | David et al. | 425/2 |
| 4,183,156 | 1/1980 | Rudy | 36/44 |
| 4,211,019 | 7/1980 | McCafferty | 36/43 |
| 4,219,945 | 9/1980 | Rudy | 36/29 |
| 4,340,626 | 7/1982 | Rudy | 428/35 |
| 4,342,158 | 8/1982 | McMahon | 36/35 R |
| 4,451,634 | 5/1984 | Hatanaka et al. | 528/24 |
| 4,674,206 | 6/1987 | Lyden | 36/88 |
| 4,780,486 | 10/1988 | Lee et al. | 522/14 |
| 4,817,304 | 4/1989 | Parker et al. | 36/114 |
| 4,831,064 | 5/1989 | Varaprath et al. | 522/99 |
| 4,874,640 | 10/1989 | Donzis | 36/92 |
| 4,876,806 | 10/1989 | Robinson et al. | 36/114 |
| 4,892,895 | 1/1990 | Arai et al. | 522/99 |
| 4,906,502 | 3/1990 | Rudy | 428/69 |
| 4,923,754 | 5/1990 | Lee et al. | 428/429 |
| 4,935,455 | 6/1990 | Huy et al. | 522/99 |
| 4,936,029 | 6/1990 | Rudy | 36/29 |
| 4,943,613 | 7/1990 | Arai et al. | 524/773 |
| 4,946,874 | 8/1990 | Lee et al. | 522/14 |
| 5,042,100 | 8/1991 | Bar et al. | 12/142 N |
| 5,042,176 | 8/1991 | Rudy | 36/29 |
| 5,082,873 | 1/1992 | Liles | 522/86 |
| 5,083,361 | 1/1992 | Rudy | 29/454 |
| 5,084,489 | 1/1992 | Liles | 522/84 |
| 5,089,537 | 2/1992 | Liles | 522/84 |
| 5,101,580 | 4/1992 | Lyden | 36/93 |
| 5,124,212 | 6/1992 | Lee et al. | 428/429 |
| 5,128,880 | 7/1992 | White | 364/550 |
| 5,177,120 | 1/1993 | Hare et al. | 523/109 |
| 5,180,756 | 1/1993 | Rehmer et al. | 522/35 |
| 5,183,599 | 2/1993 | Smuckler | 264/22 |
| 5,183,831 | 2/1993 | Bielat et al. | 522/33 |
| 5,185,385 | 2/1993 | Kanluen et al. | 522/84 |
| 5,187,040 | 2/1993 | Mueller-Hess et al. | 430/157 |
| 5,203,793 | 4/1993 | Lyden | 36/88 |

OTHER PUBLICATIONS

*Int'l Plastics Selector Adhesive Digest* 1995 pp. 21–22, 271–291, and 677–678.

*Primary Examiner*—Ted Kavanaugh

[57] ABSTRACT

A method for making a conformable device including a light cure material for use in functional relation with an article of footwear in order to enhance conformance or fit, support, comfort, and cushioning. The present invention can serve to accommodate the unique anatomical features and characteristics of an individual wearer and finds application within numerous types of articles footwear (44).

20 Claims, 11 Drawing Sheets

METHOD OF MAKING LIGHT CURE COMPONENT FOR ARTICLES OF FOOTWEAR

CROSS REFERENCE TO RELATED APPLICATION

The present application is a continuation of Ser. No. 08/275,642 filed Jul. 14, 1994, now abandoned, which is a continuation of 08/074,771, filed Jun. 9, 1993, now abandoned which is a continuation-in-part of application Ser. No. 07/976,407 filed Nov. 13, 1992, now abandoned, which was a divisional of Ser. No. 07/805,596, filed Dec. 11, 1991, that issued as U.S. Pat. No. 5,203,793 on Apr. 20, 1993, which was a continuation-in-part of Ser. No. 07/714,971 filed Jun. 13, 1991, now U.S. Pat. No. 5,101,580, which was a file-wrapper-continuation of Ser. No. 07/410,074, now abandoned, filed Sep. 20, 1989, with cross-reference to U.S. Pat. No. 4,674,206, issued to the present inventor Robert M. Lyden, on Jun. 23, 1987.

DEFINITIONS

In this specification the term "rearfoot" is used to identify the area about the heel portion of the foot substantially containing the heel bones, i.e., the calcaneus and talus. The term "forefoot" is used to identify the foot portion about the ball and toes of the foot, i.e., the area substantially containing the phalanges, sesamoids, and the distal heads of the metatarsals. The term "midfoot" is used to identify the foot portion lying between the forefoot and rearfoot as defined above. The midfoot portion therefore lies rearwardly of the distal heads of the metatarsals and forwardly of the calcaneus and talus, and substantially contains the cuboid, navicular, cuneiforms, and includes the base and a substantial portion of the shaft of the metatarsals. The anterior-to-posterior axis is understood to extend in a horizontal orientation generally consistent with the sagittal plane with the toes being anterior and the heel being posterior. The medial-to-lateral axis is understood to extend in a horizontal orientation generally consistent with the frontal plane and perpendicular to and intersecting the anterior-to-posterior axis with medial being consistent with the inner side of the foot proximate the midline of the body, and lateral being consistent with the outer side of the foot. The superior-to-inferior axis is understood to be perpendicular to both the medial-to-lateral axis and the anterior-to-posterior axis and intersects both at a single point and is substantially vertical in orientation generally consistent with a line formed by the intersection of the frontal and sagittal planes with the dorsal aspect of the foot being superior and the plantar aspect of the foot being inferior. The transverse plane is generally horizontal and is consistent with the plane formed by the intersection of the medial-to-lateral axis and anterior-to-posterior axis.

BACKGROUND OF THE INVENTION

Some individuals suffer debilitating podiatric conditions which require the fabrication of prescription orthotics by a medical doctor for remedial relief. Accordingly, it is an object of the present invention to provide a light-cure conformable device for use by skilled medical doctors and podiatrists that can quickly and effectively be used in the implementation of orthotic prescriptions, and at low cost relative to existing technologies.

However, many of the problems commonly experienced by the general public with articles of footwear simply stem from one or more of the following deficiencies; inadequate conformance or fit, stability, support, comfort, cushioning and shock absorption. Further, it can be readily understood that these qualities can be interrelated, e.g., the conformance provided by an article of footwear can contribute to the additional need or desire to improve cushioning by spacially distributing force applications and reducing shock. Accordingly, it is an object of this invention to provide in partial or complete combination, improved conformance or fit, stability, support, comfort, cushioning and shock absorption in relation to articles of footwear for members of the general public.

Eversion of the foot is sometimes generally referred to as pronation, and in particular, medial rotation of the calcaneus associated with articulation of the sub-talar joint is known as rearfoot pronation, whereas inversion of the foot is commonly referred to as supination. In accordance with the above discussion, it can be readily understood that an object of the present invention is to provide means for supporting and stabilizing a wearer's foot in an attempt to avoid possibly injurious conditions arising from excessive pronation or supination.

In brief, every individual has unique anatomical features and characteristics. A practical problem to be solved: How to accommodate for these individual differences and provide to wearers of articles of footwear individualized conformance or fit, stability, support, comfort, and enhanced cushioning, whether in partial or complete combination? Heretofore, there have been a number of attempted solutions to this problem which have enjoyed varied success. Obvious merits aside, some of the deficiencies of the prior art will be briefly addressed.

Footwear orthotics prescribed by a medical doctor are sometimes required in select cases to remedy debilitating podiatric conditions. For some individuals, there is no other practical or prudent alternative that will provide remedial relief. However, even footwear orthotics such as U.S. Pat. No. 4,470,782 taught by Robert L. Zimmerman, Jr. et al. take considerable time for a specialist to fabricate and can be relatively expensive. Prescription orthotics are not normally required for members of the general public to sucessfully enjoy the use of footwear.

Pre-formed "generic" products such as U.S. Pat. No. 4,677,766 taught by Charles J. Gudas can accommodate a greater, or lesser number of individuals depending upon the degree to which characteristic norms corresponding to the target population have been incorporated in the design of such products. In particular, foam materials of select shape have been used to partially accomodate for anatomical differences and enhance the conforming properties of articles of footwear. However, as every individual possesses different anatomical features and characteristics, a pre-formed "generic" product will not accommodate every individual to the same degree.

Various thermal formed or heat activated footwear inserts such as U.S. Pat. No. 4,237,626 taught by Dennis N. Brown have been introduced in the United States, in particular, skate and ski boot manufacturers have enjoyed some commercial success with products of this general type. However, the application of such footwear inserts generally involves the use of a relatively high temperature heating gun or oven, or other heating or molding equipment, thus requires numerous procedures which must be administered by a retailer. While generally less expensive, faster, and easier to make than prescription orthotics, methods that would possibly expose a wearer to high temperatures are not "user-friendly" for the general public.

Permanently inflated "air bags," or "diffusion pumping devices" such as those taught by Marion F. Rudy, e.g., U.S. Pat. Nos. 4,183,156, 4,219,945, 4,340,626, 4,906,502, 4,936,029, 5,042,176, and 5,082,361, all being hereby incorporated by reference herein, and U.S. Pat. No. 4,817,304 to Parker et al., hereby incorporated by reference herein, have enjoyed considerable commercial success, and have enhanced the cushioning and shock-absorbing qualities of articles of footwear. However, the use of relatively high inflation pressures in a permanently inflated "air bag," i.e., a bladder having inner volume including gaseous matter, and the like, generally achieves superior cushioning and shock-absorption at the expense of conformance due to the difficulty of manufacturing "air bags" to accomodate complex anatomical shapes, whereas the use of relatively low inflation pressures in an "air bag" characterized by a relatively thin cross-section generally achieves conformance at the expense of cushioning and shock-absorption.

As taught in U.S. Pat. No. 4,219,945 granted to Rudy, previously incorporated by reference herein, it can be advantageous to "tune" the mechanical response of a cushioning element in accordance with certain criteria, e.g., in order to influence the magnitude and rate of compression and recovery of the cushioning element when loaded by a wearer during use and thereby render the response of an article of footwear more in harmony with bodily movements: see column 2, lines 1–5, and column 7, lines 47–52. In addition, a biomechanically tuned shoe is taught by Thomas McMahon in U.S. Pat. No. 4,342,158, hereby incorporated by reference herein. Accordingly, a further object of the present invention can be to provide a "tuned" mechanical response and enhanced cushioning and shock-absorbing effects in association with the use of a conformable device.

Selectively inflatable air bladders, e.g., U.S. Pat. No. 4,874,640 taught by Byron A. Donzis, which can be inflated by manually actuating a pumping mechanism or other inflation means, can attain substantial conformance with respect to a portion of a wearer's anatomy. However, the relatively low inflation pressures generally associated with such air bladders can fail to provide optimal cushioning, or stability when such air bladders are subjected to the force applications commonly generated by wearers of athletic footwear during use.

Accordingly, an object of the present invention includes the use of a light cure material and a void including at least one gas within the inner volume of a conformable device, thereby enabling an "air bag," i.e., a bladder having inner volume including gaseous matter, to be formed to a desired shape when the light cure material is caused to set and cure.

There have been a number of attempts to introduce conformable materials such as flowable or viscous liquids, or flowable solids into articles of footwear in order to accomodate an individual wearer, e.g., U.S. Pat. No. 3,237,319 taught by A. W. Hanson, U.S. Pat. No. 3,407,406 to F. D. Werner et. al., U.S. Pat. No. 4,038,762 to Jack C. Swan, Jr., U.S. Pat. No. 4,380,569 to Robert E. Shaw, and U.S. Pat. No. 4,977,691 to Lewis P. Orchard, III. These materials generally remain flowable liquids or solids, and when subjected to a force application become moldable in conformance with a portion of a wearer's anatomy. However, such materials and devices normally resume an unformed state upon removal of an article of footwear and are therefor without a "memory" capability. This ability can be viewed as potential benefit, or alternatively, as a liability depending upon the intented object. In addition, such conformable materials threaten to add undesirable weight to an article of footwear when used in substantial quantities.

Further, there have been attempts to introduce conformable materials substantially comprising flowable liquids or solids in articles of footwear which can be caused to form substantially non-flowable solid material when caused to set and cure, e.g., U.S. Pat. No. 2,092,910 taught by C. H. Daniels, U.S. Pat. No. 3,786,580 to Melvin W. Dalebout, U.S. Pat. Nos. 4,128,951, 4,272,898, and 4,385,024 to Horace A. Tansill, U.S. Pat. No. 5,002,047 to Timothy C. Sandvig et. al., and U.S. Pat. Nos. 5,042,100, and 5,095,570 to Aharon Bar et. al.. Some of the prior art has proven deficient as result of the use of unsuitable materials or designs. Moreover, the procedures and methods associated with these attempts have for the most part been relatively complex, time consuming, expensive, or otherwise not amenable to mass production and use by the general public. The applicant has attempted to address certain deficiencies of the prior art in U.S. Pat. Nos. 4,674,206, 5,101,580, 5,203,793, and co-pending application Ser. No. 07/976,407 now abandoned, all being hereby incorporated by reference herein.

In particular, the applicant's co-pending Ser. No. 07/976,407 teaches the use of select frequencies and wavelengths of electromagnetic radiation comprising light to cause a flowable or otherwise conformable light cure material to set and cure in relation to a conformable device for conforming to and supporting a portion of a wearer's anatomy. The meaning and scope of the word "light" is hereby defined in accordance with *The New Collegiate Dictionary,* published by A. Merriam-Webster, Springfield, Mass. 1979: "an electromagnetic radiation in the wavelength range including infrared, visible, ultraviolet, and X-rays and traveling in a vacuum with a speed of about 186,281 miles per second; specifically: the part of this range that is visible to the human eye." That portion of the electromagnetic spectrum most relevant to the present application comprises ultraviolet and visible light having a wavelength substantially between 280 and 750 nanometers. A representation of a portion of the electromagnetic spectrum may be seen in *Physics,* by John D. Cutnell and Kenneth W. Johnson, published by John Wiley & Sons, New York, 1989, Figure 30.6, page 655.

Ultraviolet light cure capability presently extends, e.g., to adhesives, inks, epoxies, resins, and various polymers and copolymers including resilient elastomers. The latter presently find use, e.g., as optical coatings, and as encapsulation or insulation means for use in the electronics industry.

Further, blue light cure materials are known in the medical dental industry, e.g., FERMIT™, TETRIC™, and HELIOMOLAR RADIOPAQUE™, distributed by Ivoclar Vivadent of 175 Pineview Drive, Amherst, N.Y. 14228.

It can be readily understood that a further object of the present invention extends to the use of various inventive devices, methods, and processes, as described herein, for effecting necessary and sufficient exposure of a conformable device, or any other footwear components including light cure materials, to ultraviolet or visible light having a wavelength substantially between 280–750 nanometers in order to provide in partial or complete combination; individualized conformance or fit, improved stability, support, comfort, and cushioning effects.

Moreover, the present invention anticipates the possible use of light cure materials in the manufacture and production of various component parts of articles of footwear, e.g., the making of sockliners, midsoles, and shoe uppers. Presently, conventional manufacturing processes are relatively energy, labor, and material intensive, as compared with light cure methods and processes recited herein. For example, the forming of a conventional resilient foam midsole commonly requires a cycle time of 5–7 minutes in a mold utilizing considerable heat and pressure. It is then a further object of the present invention to improve production methods and processes relevant to the manufacture and production of articles of footwear.

SUMMARY OF THE INVENTION

The present invention includes a conformable device including a light cure material for use in an article of footwear for enhancing conformance or fit, comfort, stability, support, and cushioning, whether in partial or complete combination. Further, the present invention includes various methods and devices for effecting light cure and accomplishing the aforementioned objectives.

In a preferred embodiment, a conformable device for use in an article of footwear and conforming to and supporting a portion of a wearer's anatomy comprises a chamber having inner volume, a conformable light cure material included therein and displacing at least a portion of the inner volume, the chamber being comprised at least in part of a pliable casing that is capable of transmitting ultraviolet or visible light having a wavelength substantially between 280 and 750 nanometers capable of causing the light cure material to set and cure, whereby when a portion of the wearer's anatomy is positioned in functional relation to the conformable device to cause a force application to be made thereupon and cause at least a portion of the conformable device to be formed in substantial conformance with the portion of the wearer's anatomy, and the light cure material is exposed to ultraviolet or visible light having a wavelength substantially between 280 and 750 nanometers to cause the light cure material to set and cure, the conformable device substantially retains the shape imparted by the portion of the wearer's anatomy.

Further, in a preferred embodiment of a conformable device the light cure material is isolated from ultraviolet or visible light by a selectively removable barrier material, whereby premature exposure of the light cure material is prevented.

Further, in a preferred embodiment of a conformable device the pliable casing is made from a substantially transparent plastic material.

Further, in an alternate preferred embodiment of a conformable device the chamber further includes a foam material. In addition, the foam material can comprise a shape generally conforming to a portion of a wearer's anatomy. The select and coordinated use of the foam material in communication with a light cure material can provide select physical and mechanical properties to be exhibited as between at least two portions of the conformable device, as desired.

Further, in a preferred embodiment of a conformable device the light cure material comprises a resilient material after being caused to set and cure.

Further, in a preferred embodiment of a conformable device for use as a insole or sockliner, the conformable device underlies at least a portion of the wearer's medial longitudinal arch and extends from an area about the heel to an area rearward of the metatarsal heads.

Further, in an alternate preferred embodiment of a conformable device, the conformable device includes means for removable attachment in functional relation to an article of footwear, e.g., a self-adhesive surface.

Further, an alternate preferred embodiment of a conformable device, the conformable device further includes a void including at least one gas. It can be readily understood that a gas can be pressurized above atmospheric pressure. In addition, gaseous matter can comprise, at least in part, ambient air, or a "supergas" as recited by in the U.S. Patents to Rudy previously incorporated by reference herein, e.g., hexafluoroethane, or sulfur hexafluoride, and the like. Furthermore, it can be readily understood that the inclusion of a light cure material within a conformable device forming, at least in part, an air bag or bladder can cause the conformable device to be formed to a desired shape when the light cure material is made to set and cure.

Further, in an alternate preferred embodiment of a conformable device the light cure material includes a foaming or blowing agent and comprises a foam material after being caused to set and cure.

Further, in an alternate preferred embodiment of a conformable device, the conformable device comprises an open-celled foam material impregnated with a light cure material.

Further, in an alternate preferred embodiment of a conformable device, the conformable device can comprise a textile material, and the like, including an interpenetrating light cure material.

Further, in an alternate preferred embodiment of a conformable device, the conformable device can substantially comprise a conformable light cure material.

Further, in an alternate preferred embodiment of a conformable device, the conformable device is used in conjunction with a wedge or post, and the like, for introducing an adjustment or correction as prescribed by a skilled medical doctor or podiatrist.

A preferred method for permitting the transmission of suitable ultraviolet or visible light to a conformable device within an article of footwear includes the provision of an opening and/or the use of a transparent material, and the like.

An alternate preferred method for permitting the transmission of suitable ultraviolet or visible light to a conformable device within an article of footwear includes the provision of an electroluminescent lamp therein, and the like.

An alternate preferred method for permitting the transmission of suitable ultraviolet or visible light to a conformable device within an article of footwear includes the provision of fiber optic material therein, and the like.

An alternate preferred method for permitting the transmission of suitable ultraviolet or visible light to a conformable device positioned within an article of footwear, or outside an article of footwear, includes the use of a light table, and the like.

A preferred device for use in the manufacture and production of footwear components utilizing light cure materials, e.g., sockliners, midsoles or soles and shoe uppers, comprises a substantially transparent mold, and the like.

A preferred method for the manufacture and production of footwear components made with a light cure material comprises the following steps, or their equivalent:

a) a suitable mold for effecting light cure is opened;
b) optionally, a release agents is sprayed into the mold;
c) the mold is filled with a predetermined quantity of light cure material, and any other desired components;
d) optionally, the mold environment is maintained at controlled atmospheric conditions, e.g., temperature;
e) optionally, the light cure material includes a suitable blowing or foaming agent and the activity of this agent is coordinated with the engineered cure time of the light cure material;

f) the mold is closed and sufficient force is applied to maintain closure;

g) optionally, the blowing or foaming of the light cure material proceeds as desired;

h) the light cure material contained within the mold is exposed to a suitable light source for effecting the engineered cure time;

i) the mold is opened and the component is removed;

j) continue as desired in a closed loop to step b and proceed through step j.

Furthermore, it can be readily understood that the present invention anticipates the design, manufacture and use of various preferred conformable devices utilizing light cure materials for users of various articles of protective and athletic equipment, and other devices and objects. For example, the use of shin guards, knee pads, thigh pads, hip pads, rib guards, shoulder pads, elbow pads, neck guards, face guards, protective hand and forearm equipment and helmets is prevalent in a large number of contact and non-contact sports, such as football, hockey, baseball, soccer, and volleyball. Protective helmets and knee pads are also used in the construction industry, and helmets of various kinds enjoy wide use in the military and in the field of transportation, e.g., bicycle and motorcycle operation. Suitable conformable devices could also be used to advantage with various prosthetic devices, and seats. The ability to provide mass produced articles of footwear, articles of protective and athletic equipment, and other devices and objects makes the invention available for use by the general public.

The procedures and methods associated with the use of preferred embodiments of the present invention are few and simple to perform, thus render use by the general public both possible and practical. Further objects and advantages of the invention will become apparent from a consideration of the drawings and ensuing description of it.

The above described features and advantages, along with various other advantages and features of novelty are pointed out with particularity in the claims of the present application which are attached hereto. However, for a better understanding of the invention, its advantages, and objects obtained by its use, reference should be made to the drawings which form a further part of the present application and to the accompanying descriptive material in which there is illustrated and described preferred embodiments of the present invention.

DETAILED DESCRIPTION OF THE PREFERRED EMBODIMENTS

Figure 1:
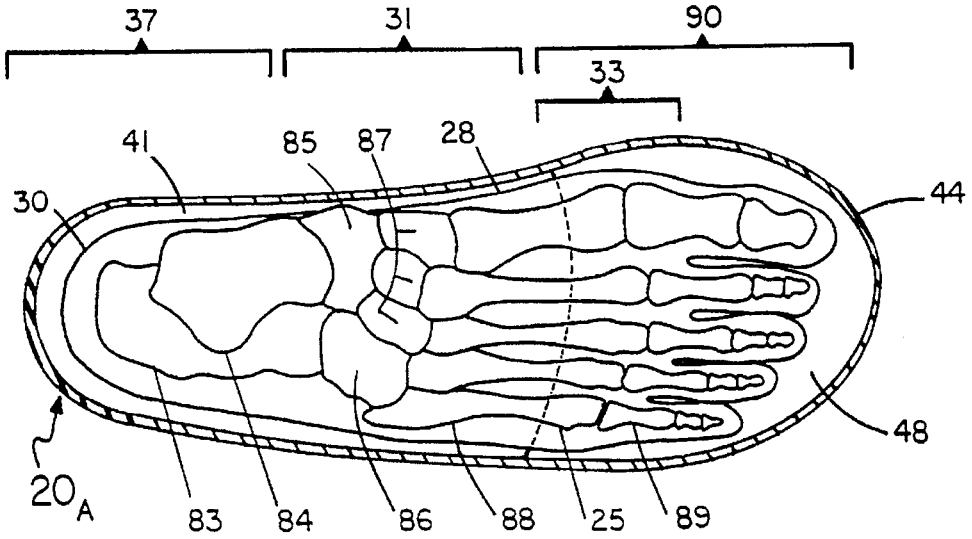
FIG. 1 is a top plan view of a conformable device substantially comprising a conformable light cure material for use in the area of the footbed of an article of footwear showing the position of the conformable device in relations to various bones of a wearer's foot.

General reference to an embodiment of the present invention will be indicated by the term "conformable device," and the numeral 20. Various specific embodiments will be indicated by the term "conformable device" and the addition of an alphabetical suffix to reference numeral 20. Referring the the figures, wherein like reference numerals represent like parts throughout the several views, a conformable device 20*a* for customizing the footbed 48 of an article of footwear 44 is shown in FIG. 1. Conformable device 20*a* substantially comprises a conformable light cure material 41 that can be made to set and cure when exposed to ultraviolet or visible light having a wavelength substantially between 280–750 nanometers. When a wearer imparts a force application upon conformable device 20*a* causing the light cure material 41 to be formed in approximate conformance with a portion of the wearer's foot and the light cure material 41 is then caused to set and cure, the shape imparted by the wearer's foot can be substantially retained, thus giving to conformable device 20*a* a permanent "memory" capability. It can be readily understood that light cure material 41 can be caused to set and cure when a wearer's foot is placed in position upon conformable device 20*a*, or alternatively, be caused to set and cure thereafter when the light cure material 41 being used is capable of retaining the shape imparted thereto for an extended period of time.

PLIABLE CASING

A conformable device 20*c* can be formed at least in part by a pliable casing 22, approximately 0.0508–1.21 mm (0.002–0.050 inches) in thickness. Other thicknesses can be suitable depending upon the material(s) being used, and the method and process of manufacture. It is normally advantageous that the pliable casing be relatively thin in cross-section, but also as clear or transparent as possible in order to enhance the transmission of light therethrough. In this regard, it has been found that the thickness of the material is not so much a limiting factor, as is the relative clarity or transparency of the material. It can be advantageous to select a tinted or colored transparent pliable casing for enhancing the transmission of a particular color of visible light having a wavelength approximately between 400–750 nanometers which is especially suitable for causing a selected visible light cure material to set and cure.

The pliable casing 22 can be made, at least in part, from a material related to the group of plastics, thermoplastics, polymers, copolymers, natural and synthetic rubbers, comprising silicone, urethane, polyurethane, polyester, polyethylene, polycarbonate, polyvinyl chloride, propylene, polypropylene, polyamide, neoprene, styrene, nylon, vinyl, nitrile, butadiene acrylonitrile and styrene rubber, latex, other natural and synthetic rubbers, and the like. In addition, pliable casing 22 can also be formed, at least in part, by natural or synthetic leather, a foam material, a textile, a fabric, or composite material, e.g., a foam and textile laminate, whether in partial or complete combination.

The pliable casing 22 can format least one chamber 51 having inner volume and comprises a durable material, thus enabling a conformable device 20*c* to withstand the loads anticipated during implementation of the present invention and normal use. The pliable casing 22 is heat/pressure sealed, welded by radio frequency induction, vacuum formed, blow-molded, or otherwise formed, bonded or affixed along any mating edges using conventional means so as to render conformable device 20*a* a substantially self-enclosed unit. In addition, pliable casing 22 can be subjected to plasma or corona etching, or can otherwise be treated by conventional means to improve the bonding capability of the pliable casing 22 to various materials.

Figure 4:
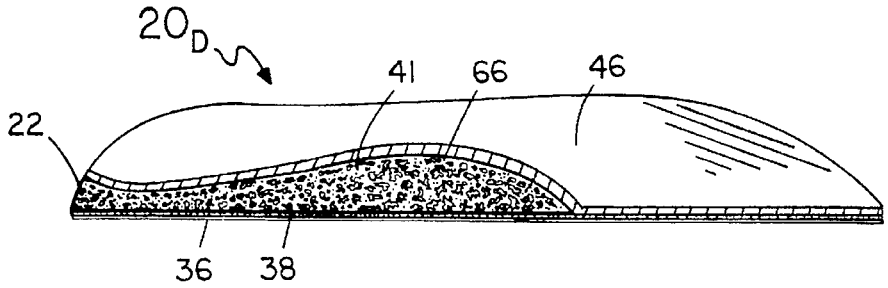
FIG. 4 is a cross-sectional perspective view along the anterior-to-posterior axis of a conformable device similar in general shape to that shown in FIG. 3, but with the addition of an overlying sockliner material and an underlying protective layer that can be removed to expose a self-adhesive surface.

It can be readily understood that members of pliable casing 22 can be affixed to a different material to form a chamber 51 of a conformable device. For example, as shown in FIG. 4, a conformable device 20*d* can be formed in association with an overlying insole or sockliner 46 and use a portion of the insole for structural integrity and enclosure. In an alternate embodiment, an overlying insole can comprise at least in part a foam material and the inferior portion thereof can be formed to a select shape generally conforming to a portion of a wearer's anatomy and be substantially contained within the inner volume of a conformable device so as to simultaneously serve the function of a pliable casing, and a foam material of select shape (not shown).

STRUCTURAL PATTERN

Figure 11:
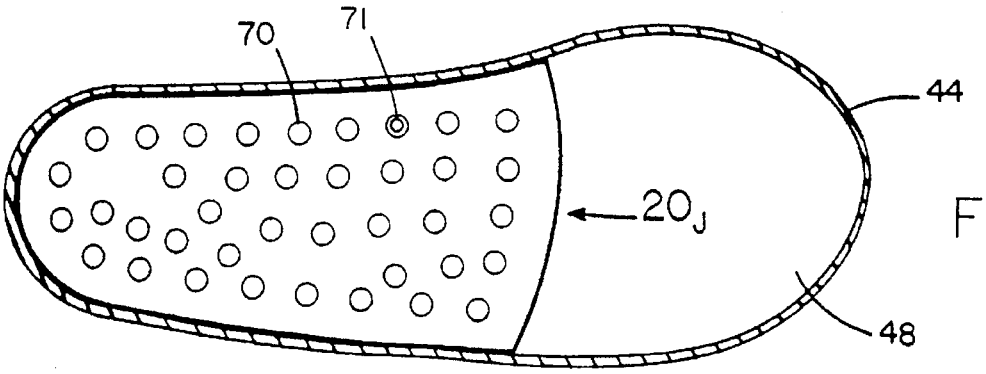
FIG. 11 is a top plan view of a conformable device showing opposing members of pliable casing joined in an asymmetric structural pattern.

As shown in FIG. 11, a pliable casing 22 can be selectively affixed or otherwise formed by conventional means to comprise at least one structural pattern 70. A structural pattern 70 can selectively contain and direct the movement of a flowable or otherwise conformable light cure material 41 within conformable devices 20*j* prior to cure. In addition, as shown in FIG. 11, a structural pattern 70, and the like, can also form at least one opening 71 through a conformable device 20*j* in isolation from the inner volume of the conformable device 20*j* for permitting the ventilation of matter, e.g., liquids, and gases.

INCLUSION OF GAS

Figure 40:
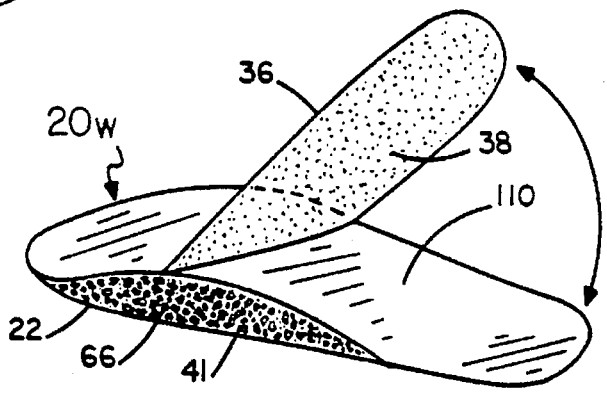
FIG. 40 is a perspective view of a conformable device having a pliable casing comprised, at least in part, of a selectively permeable material which is readily permeable to gases, but substantially impermeable to liquids.

The possible use of a selectively permeable material in at least a portion of pliable casing 22 is anticipated in various embodiments of the present invention, in particular, select permeability to gaseous matter, and of course, the capability to transmit preferred ultraviolet and visible light having a wavelength substantially between 280 and 750 nanometers. As shown in FIG. 40, a pliable casing 22 which includes a selectively permeable material 110 to even relatively small gaseous molecules can permit ventilation of gases generated by the possible introduction of a foaming or blowing agent with light cure material 41 in conformable device 20*w*.

Figure 28:
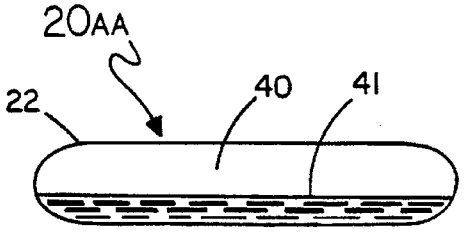
FIG. 28 is a cross-sectional view of a conformable device including an uncured light cure material in a liquid state, and a void including a gas.

In those embodiments in which the pliable casing is only capable of transmitting light, or alternatively, when the pliable casing is substantially impermeable to at least relatively large gaseous molecules, at least one gas can be used within a conformable device 20*aa*, as shown in FIG. 28, and the like. It can be readily understood that inclusion of a gas will form at least one void 40 within the inner volume of conformable device 20*aa*. When left unrestrained by an internal structure entrapped gas(es) will naturally tend to rise to the highest point(s) within the inner volume of a conformable device 20*aa*. It can then be desired to introduce at least one internal structure (not shown) within some embodiments of the present invention to ensure select containment of entrapped gas(es). The inclusion of entrapped gas(es) can serve to reduce the weight by volume of a conformable device, aid in attentuating force applications and shock, or otherwise positively affect the physical and mechanical properties of a conformable device. Accordingly, the quantity of light cure material and any gas introduced within a conformable device can be anticipated or regulated during production.

Further, the present invention can be used in a synergistic manner with other footwear inventions, and in particular, at least one of the inventions of Rudy, as previously recited and incorporated by reference herein, to yield a hybrid conformable device. Substantial impermeability of a suitable pliable casing to relatively large and inert gaseous molecules or "supergases," but relative permeability to relatively small gaseous molecules can enable the operation of a "diffusion pumping" device, as taught in the aforementioned patents to Rudy. Usable "supergases" include hexafluoroethane, and in particular, sulfur hexafluoride, and the like. The applicant has effected the cure of suitable light cure materials both in external and internal relation to various inflated air bags constructed in accordance with the teachings of Rudy, and no special difficulty has been encountered. Again, the use of a substantially transparent pliable casing will generally permit more rapid and effective setting and cure of a light cure material.

For example, as shown in FIG. 28, a conformable device 20*aa* could contain at least one so-called "supergas" of Rudy's teaching in order to selectively affect the mechanical and other physical properties of conformable device 20*aa*, and the like. It can be readily understood that the use of a light cure material 41 within a conformable device 20*aa* including a void 40 containing at least one gas can enable conformable device 20*aa*, and the like, to be formed to a desired shape. As can be appreciated, the task of permanently forming an air bag or bladder to a desired shape in conformance, e.g., with a portion of a unique individual's anatomy, is something not easily accomplished by conventional means.

Figure 32:
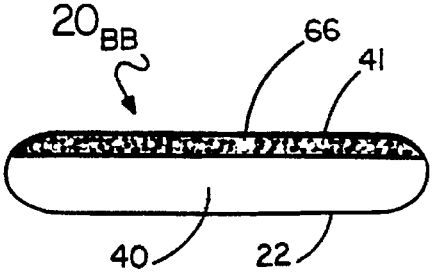
FIG. 32 is a cross-sectional view of a conformable device including light cure material, an open-celled foam, and a void including a gas.
Figure 38:
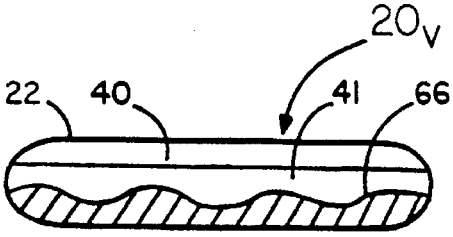
FIG. 38 is a cross-sectional view of a conformable device including light cure material, a closed-celled foam, and a void including a gas.

As shown in FIGS. 32 and 38, conformable devices 20*bb*, and 20*v*, respectively, can include a foam material 66, and a void 40 containing at least one gas, and if desired, a "supergas" consistent with the teachings of Rudy.

Figure 39:
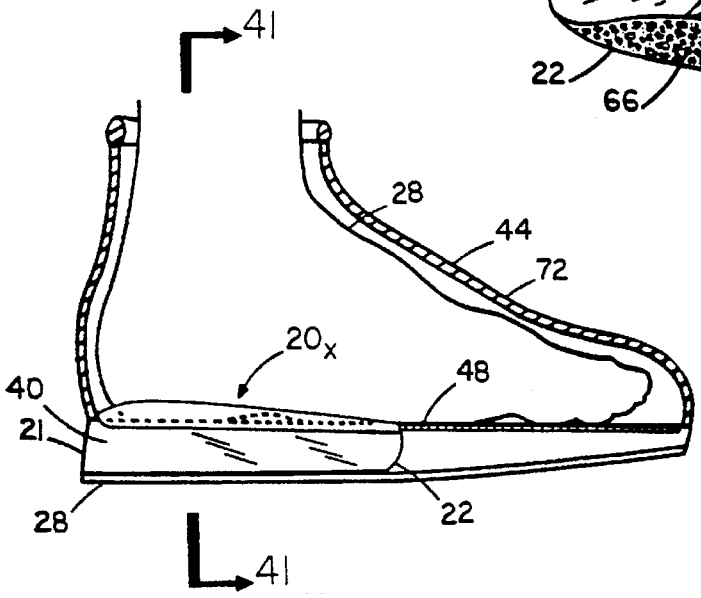
FIG. 39 is a side cross-sectional view of a conformable device having a void including a gas in an article of footwear.
Figure 41:
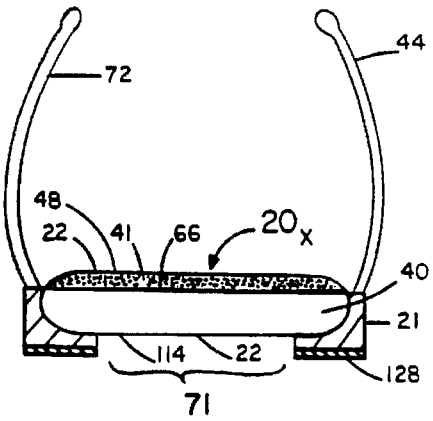
FIG. 41 is a cross-sectional view of conformable device 20*x* along line 41—41, as shown in FIG. 39, showing a conformable device having a void including a gas positioned in functional relation to a midsole of an article of footwear.

As shown in FIGS. 39 and 41, conformable device 20*x* can include a light cure material 41, a void 40 containing a gas, and can be encapsulated or stock fitted in the midsole 21 of an article of footwear 44. A conformable device 20*x*, and the like, can render the midsole 21 at least partially conformable with respect to the plantar aspect of a wearer's foot.

FOAM MATERIAL

Figure 3:
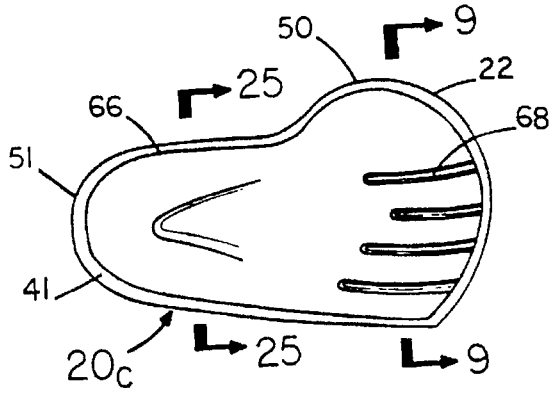
FIG. 3 is a bottom plan view of a conformable device for use in an article of footwear similar to that shown in FIG. 2, but with the addition of foam material of desired shape within the conformable device.

As seen in FIG. 3, at least one foam material 66 can be used within the inner volume of a conformable device 20*c*, and the like. Inclusion of a foam material 66 can substantially reduce the overall density or weight by volume of a conformable device 20*c* and can at least partially determine the physical and mechanical properties of a conformable device 20*c*. In addition, a foam material 66 can be formed to a desired shape, e.g., generally conforming to a portion of a potential wearer's anatomy, and can thereby selectively provide form and structure with regards to a conformable device 20*c*, and the like. Further, a select foam material can be configured to direct the displacement of a light cure material 41 between an appendage 50 and chamber 51 of a conformable device.

Figure 9:
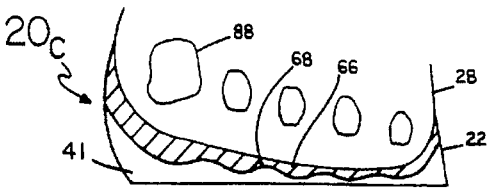
FIG. 9 is a cross-sectional view along the medial-to-lateral axis of the conformable device of FIG. 3, along line 9—9, with a wearer's foot in position.

It can be readily understood that the coordinated use of a select foam material 66 with a select light cure material 41 can produce a synergistic result and enable select physical and mechanical properties to be exhibited by various portions of a conformable device 20*c*, as shown in FIG. 9. For example, in one select cross-sectional area a foam material 66 exhibiting greater stiffness in compression might be used in greater proportion relative to a light cure material 41 which forms a material exhibiting less stiffness in compression when cured, whereas in another select area the proportions could be reversed. Further, the stiffness and other mechanical characteristics of the foam material 66 and light cure material 41 could be just the opposite of those described above. Obviously, the configuration of a conformable device can also affect the mechanical properties exhibited in one or more portions. It can then be readily understood that the teachings disclosed herein provide solutions to the need or desire to selectively "tune" the physical and mechanical properties of various portions of a conformable device.

The foam material 66 can be made from a material or materials related to the group of resins, plastics, thermoplastics, polymers, copolymers, natural and synthetic rubbers forming open or closed cell foams comprising silicone, urethane, polyurethane (microcellular, ester, ether, reticulated), polyamide, polyethylene (linear, cross-linked), latex, neoprene, nitrile, polyvinyl chloride, ethylene vinyl acetate (EVA), other natural or synthetic materials, and the like. A foam material 66 can be surfaced, e.g., with a self-skin, embossed, laminated with a textile, laminated with a thermoplastic or polymer film, or treated with a primer or adhesive material. In addition, a foam material 66 can be selectively affixed to pliable casing 22 to at least partially define the form of a conformable device and selectively determine the mechanical properties exhibited in select areas of a conformable device. Further, a different foam material (not shown), or other form of matter can be used in communication with a desired foam material within a conformable device. In particular, a silicone gel, e.g., Dow Corning SYLGARD® 527, and the like, can be embedded, encapsulated, interpenetrate, or otherwise be used as desired with a foam material to provide desired physical and mechanical properties in at least one portion of a conformable device.

In some instances, a relatively smooth-skinned or closed cell foam material can be advantageous for use with a conformable device since such materials can generally maintain relatively low weight by preventing substantial penetration and absorption of a light cure material within a foam material. Further, relatively smooth surfaces on a foam material can facilitate at least partial envelopment and encapsulation of the foam material by a light cure material. However, a relatively rough, textured, or otherwise irregular surface can facilitate the bonding or affixing of a foam material to the pliable casing, light cure material, or other materials used in a conformable device.

Figure 26:
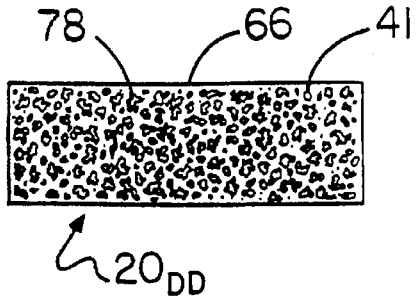
FIG. 26 is a cross-sectional view showing a representation of the structure of an open celled foam and including an interpenetrating light cure material.

In other instances, various open celled foam materials which permit interpenetration of a light cure material can be used. Further, such impregnated foam materials can sometimes be utilized as an alternate embodiment of a light cure conformable device without the further need of a pliable casing, as shown in FIG. 26. Moreover, textiles which can be impregnated with a light cure material can similarly be used in association with a conformable device, or alternately, can be used to make separate articles or elements, e.g., a portion of a conformable light cure footwear upper.

As shown in a cross-sectional view of conformable device 20*c* in FIG. 9, a select foam material 66 can be formed, shaped, or heat/pressure molded using conventional techniques to exhibit raised contours 68 of desired configurations. It can be readily understood that a foam material 66 can be configured to generally enhance the fit and conformance of a conformable device, and to permit at least partial envelopment and encapsulation of a foam material 66 by light cure material 41. Accordingly, when the light cure material 41 is caused to cure, the foam material 66 can be at least partially "entrapped" and encapsulated by the light cure material, thus causing the impression or shape molded in approximate conformance with a portion of a wearer's anatomy to be retained.

However, it is important that the introduction of a foam material 66 not compromise the task of curing of the light cure material 41. For example, it would be undesirable to block the anticipated direction of the penetrating light, or light source with an obscuring foam material. It can therefore be advantageous to utilize a relatively transparent foam material. It can also be advantageous to affix a selected foam material to a portion of the pliable casing generally opposite the anticipated direction of the penetrating light, or light source so that the light cure material will not be able to pass behind the foam material, and thereby, possibly be shielded from the light source. In addition, it is advisable to check the chemical compatability of all materials being used in order to safeguard against any possible inhibition of the selected light cure material.

LIGHT CURE MATERIALS

Suitable light cure materials generally comprise flowable liquids, viscous liquids, and flowable or otherwise conformable solids which can be caused to comprise less flowable or conformable, or completely non-flowable or conformable solid matter after the effecting of light cure. For the purpose of more clearly defining the relative magnitude of this transformation: 1) a doubling of the viscosity of a liquid or viscous light cure material; or alternately; 2) a 25 percent increase in the hardness of a light cure material on a Shore scale; or alternately, 3) a 25 percent increase in the stiffness of a light cure material in bending or compression, or alternately and as generally preferred, 4) a change in the phase state of a light cure material substantially comprising flowable liquid or viscous matter which substantially comprises solid matter after being caused to set and cure shall be considered within the scope of the present invention. Generally, light cure materials comprise one or more monomers or oligomers comprising liquid, or viscous matter which are capable of polymerization and crosslinking to form solid matter when a suitable photoinitiator included therein is excited by light having a particular wavelength, thereby causing at least one chemical reaction, typically involving free radicals, which ultimately results in the desired polymerization and crosslinking chemical reaction.

Light cure materials for use in the present invention can be made from a material or materials related to the group of epoxies, resins, polymers, copolymers, plastics, natural and synthetic rubbers comprising silicone, silicone gel, urethane, acrylated urethane, polyurethane, polyethylene, polycarbonate, polyvinyl chloride, propylene, polyamide, vinyl, nylon, polyester, styrene, other natural and synthetic rubbers, and the like.

Examples of ultraviolet-cure silicone materials are recited in U.S. Pat. No. 4,451,634 assigned to General Electric Company, U.S. Pat. Nos. 4,892,895 and 4,943,613 assigned to Shin-Etsu Chemical Company, Ltd., U.S. Pat. No. 4,935,455 assigned to Toshiba Silicone Company, Ltd., and U.S.

Pat. Nos. 4,780,486, 4,923,754, 4,831,064, 4,946,874, 5,082,873, 5,084,489, 5,089,537, and 5,124,212 assigned to Dow Corning Corporation of Midland, Mich., all the above identified patents being hereby incorporated by reference herein.

More specifically, several of the above recited patents assigned to Dow Corning Corporate relate, e.g., to a product identified as OPTIGARD® Q3-6696 optical fiber coating. This silicone elastomer cures in less than one second to one quarter inch depth when exposed to 350 millijoules/cm2 of radiation from industrial ultraviolet lamps emitting wavelengths at approximately 350 nanometers. Industrial ultraviolet exposure systems are manufactured by UVEXS Incorporated of 580 North Pastoria Avenue, Sunnyvale, Calif. 94086. Technical materials provided by UVEXS Incorporated are attached to the present application, and are hereby incorporated by reference herein. Further, the applicant has found that OPTIGARD® Q3-6696 silicone elastomer will cure to one quarter inch depth in less than thirty seconds in a tanning bed utilizing 165 watt fluorescent lamps, between thirty seconds and one minute using a 40 watt aperatured fluorescent lamp, and between three and five minutes in direct sunlight. Technical data sheets pertaining to OPTIGARD® are attached to the present application, and are hereby incorporated by reference herein.

Further, an example of an ultraviolet cure urethane material is "CN 966," a highly flexible aliphatic urethane acrylate resin which can be used as desired, e.g., with "SR-399" monomer, and approximately ten percent by volume of ESACURE® "KT/37" photoinitiator, all being products of the Sartomer Company of Oaklands Corporate Center, 468 Thomas Jones Way, Exton, Pa. 19341. Technical data sheets pertaining to these Sartomer materials are attached to the present application, and are hereby incorporated by reference herein. Dow Corning Corporation's Q3-6766 acrylated urethane is another suitable material, and a technical sheet pertaining to this product has been attached to this application, and is hereby incorporated by reference herein.

Examples of other recently patented light cure materials are recited in U.S. Pat. No. 5,177,120 assigned to Dentply Research & Development Corporation of Germany, U.S. Pat. No. 5,183,599 to Jack H. Smuckler, U.S. Pat. No. 5,187,040 assigned to Hoechst Aktiengesellschaft of Germany, U.S. Pat. No. 5,180,756 assigned to BASF Aktiengesellschaft of Germany, U.S. Pat. No. 5,183,831 assigned to Ciba-Geigy Corporation of Michigan, and U.S. Pat. No. 5,185,385 assigned to Texico Chemical Comapany of California, all the recited patents being hereby incorporated by reference herein. LITE-TAK® products, made by Loctite Corporation of Newington, Conn. provide another example of light cure materials. The above discussion demonstrates the wide range of materials and manufacturers presently associated with light cure technology.

Many ultraviolet light cure materials can be adapted for visible light cure. For example, the applicant has caused to be substituted a visible light photoinitiator, specifically, a blue light photoinitiator identified as "H-NU 470" with an accelerator "E-111" made by Spectra Group Limited of 1722 Indian Wood Circle, Suite H, Maumee, Ohio 43537, characterized by a relatively wide absorbant spectrum having a spectral peak at a wavelength of approximately 470 nanometers, at approximately one half percent by volume for the more conventional ultraviolet light photoinitiator "KT/37" and effected the cure of a combination of "CN 966" and "SR-399" to one eighth inch depth with a blue-coated 100 watt floodlight in less than three minutes. Technical data sheets pertaining to "H-NU 470" and "E-111" are attached to the present application and are hereby incorporated by reference herein. Similar results have been obtained using a 40 watt full-spectrum fluorescent lamp which unlike many conventional fluorescent lamps contains much of the blue light spectrum.

It is advantageous that light cure materials generally do not yield a substantial exothermic (heat-producing) chemical reaction. However, as shown in FIG. 4, a personalized conformable device 20*d* could be placed within an article of footwear 44 in such a manner as to substantially insulate the wearer from any possible exotherm as a light cure material 41 would set and cure. It can be advantageous to include a primer or binder, and the like, in the formulation of a light cure material for enhancing the bonding capability of the light cure material, e.g., to a pliable casing, foam material, or other form of matter associated with the fabrication and use of a conformable device.

NEW LIGHT CURE MATERIALS

Generally, a quantity of light cure material must be completely exposed to a suitable light source in order to be completely caused to set and cure, that is, if one portion of a light cure material is exposed to a suitable light source it can be made to set and cure, whereas an adjoining portion shielded from a suitable light source will remain unaffected. The applicant is presently working to overcome this limitation by research and experimentation. It is therefore anticipated that suitable light cure materials can be produced which will be capable of setting and curing in their entirety, even when only a portion is exposed to a suitable light source. Moreover, light cure materials presently exist which have a "shadow cure" capability, that is, an alternative cure capability, e.g., moisture cure, as is the case with at least one of the silicone materials recited above in the U.S. Patents to Dow Corning Corporation, and previously incorporated by reference herein.

COLOR INDICATORS

Coloring agents can be used to identify a particular light cure material and the associated general physical and mechanical properties of a conformable device. Coloring agents can also be used to indicate the completion of the light cure chemical reaction. For example, "H-NU 470" blue light photoinitiator is orange in color and bleaches to a pale orange or clear when exposed to a suitable blue light source. This change takes place as the photoinitiator is excited by the blue light source (orange being the compliment of blue). Accordingly, the photoinitiator gives the same color change to any relatively colorless light cure material in which it is being used. Other color changes are possible to effect as desired, e.g., it is possible to include a further coloring agent, e.g., a green coloring agent to mask the orange photoinitiator with the result that the light cure material will change from a green color to a blue color when the corresponding blue light cure is completed. This can facilitate successful implementation of the present invention. Obviously, the use of photoinitiators corresponding to different portions of the visible light spectrum, or the ultraviolet light spectrum is possible and such can result in different colorations being given, as desired, to a light cure material. Again, suitable photoinitiators are commercially available, e.g., Spectra Group Limited of 1722 Indian Wood Circle, Suite H, Maumee, Ohio 43537.

WORKING/CURE TIME

Further, the working, setting or cure time of the light cure material can be selected according to certain criteria.

Figure 44:
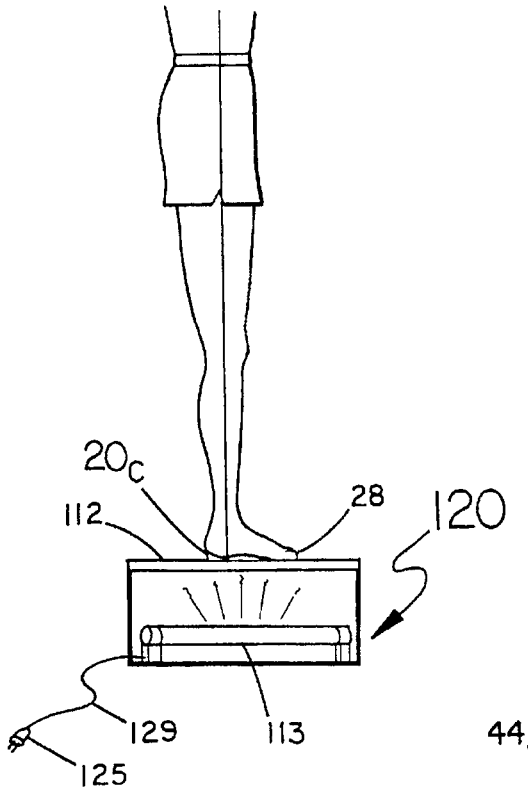
FIG. 44 is a cross sectional side view of a light table including a light source and a substantially transparent platform with a wearer's foot in position on a conformable device.

Generally, it is advantageous for the light cure material to have a working time of less than three minutes. When using a light table 120 as shown in FIG. 44, light cure materials can be caused to cure in less than one minute. However, a longer or shorter working time could be suitable depending upon the particular materials being used and the particular application. The working time of a light cure material can generally be regulated as desired by proper selection(s) regarding the type(s), amount(s) and concentration(s) of the photoinitiator and accelerators(s) being used with a selected light cure material, and selections made regarding the quality and intensity of the light source.

FILLER MATERIALS

In addition, a light cure material can include at least one filler material to further reduce the density and weight by volume of the light cure material, or to otherwise influence the physical or mechanical properties of the light cure material and conformable device in a desired manner. For example, the inclusion of fillers within some light cure materials can perform useful work regarding the attenuation of force applications and shock.

Organic or inorganic microspheres are suitable fillers, although other filler materials are also useable. For example, foam material can be used in a plurality of relatively small portions as a filler material. However, the use of a foam material of desired shape can serve other useful purposes, as described above. In can be readily understood that various talks, cork material, and other natural or synthetic materials can be used as a filler material. It can be advantageous to utilize relatively transparent fillers that are capable of transmitting light so as to not adversely affect the curing of light cure materials.

More specifically, organic microspheres manufactured by the KemaNord Company, Sweden, with product designation EXPANCEL® having a density in the range of 0.04 gram/cm3 can constitute a suitable and substantially inert lightweight filler. Organic microspheres have elastic properties in addition to their low density. Commercially available organic microspheres are commonly composed of PVDC/AN (polyvinylidene chloride/acrylonitrile) copolymer, carbon, phenolic materials, and the like. Inorganic microspheres having select densities can also be used as a filler in various applications of the present invention and these include, e.g., SCOTCHLIGHT GLASS BUBBLES®, manufactured by the 3M Company, and Z-LIGHT SPHERES®, manufactured by Zeelan Industries, Inc., both of St. Paul, Minn. Commercially available inorganic microspheres are commonly composed of soda lime borosilicate, sodium borosilicate, silica, aluminosilicate, fly ash, perlite, ceramics, and the like. In contrast with organic microspheres, inorganic microspheres do not possess substantial elastic properties and they thus tend to more readily increase the overall hardness of an encapsulating light cure material. For this reason it is necessary to use a softer durometer light cure material in conjunction with inorganic microspheres when a specific range of overall resultant hardness is desired.

HARDNESS/STIFFNESS

Figure 15:
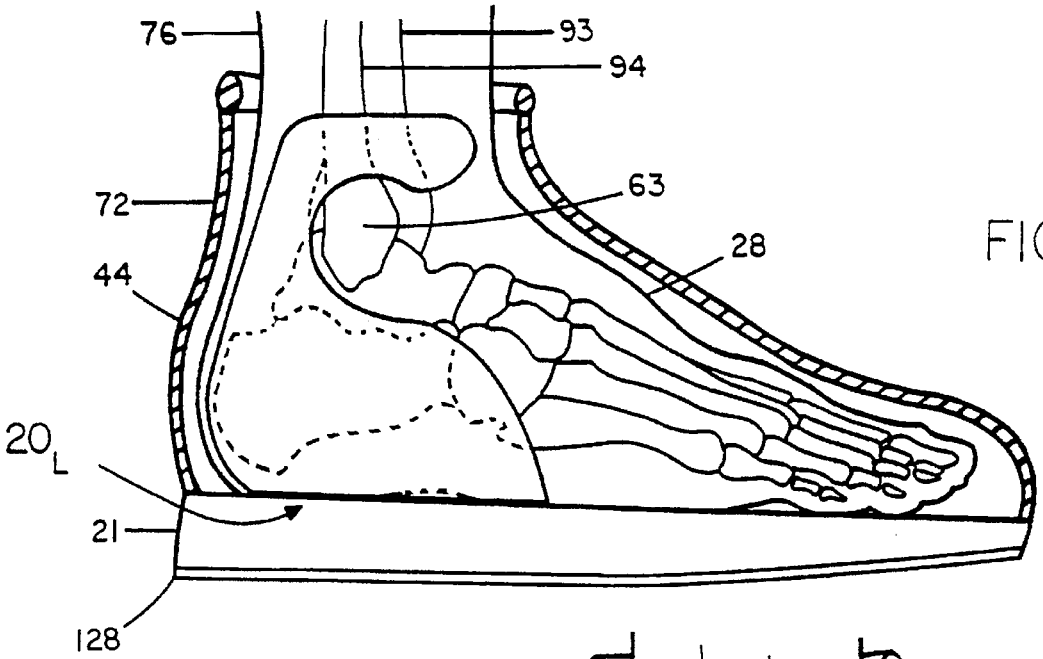
FIG. 15 is a lateral view of a conformable device for use in an article of footwear located in the area about the lateral malleolus showing the relation of the conformable device to various bones of a wearer's foot.

The hardness of the light cure material to be used in a conformable device should be selected according to certain criteria. Generally, the preferred light cure material has a hardness in the range of 10–60 Shore A, although other Shore scales of hardness are commonly used in the industry, and other measures can be more appropriate for use depending upon the nature of the light cure material selected for use in a particular embodiment of the present invention. A light cure material having a hardness corresponding to 10–60 Shore A can at least partially attenuate force applications and dampen shock while at least partially conforming about a portion of the wearer's anatomy in relation to an article of footwear. Nevertheless, it can be readily understood that the physical and mechanical properties of a light cure material, e.g., hardness, stiffness in bending and compression, to be used in various alternate embodiments of a conformable device can be selectively determined. As shown in FIG. 4, conformable device **20*d* is used to customize a sockliner and could use a light cure material 41 that would cure, e.g., to a hardness of 35 Shore A. As shown in FIG. 15, a conformable device 20L is used to customize an article of footwear 44 in the area about the lateral malleollus 63 and could use a light cure material 41** that would cure, e.g., to a hardness of 45 Shore A. Obviously, harder light cure materials, e.g., in the range of 50–90 Shore D, could be suitable for producing customized heel counters, or rigid support portions of ski boots and skates.

TUNED MECHANICAL RESPONSE

The select design, materials, construction and functional engineering of a conformable device can be coordinated in such a manner as to yield desired physical and mechanical properties. In some embodiments, included amongst these desired physical and mechanical properties are those relevant to the attenuation of force applications and shock.

Again, as taught in U.S. Pat. No. 4,219,945 to Rudy, previously incorporated by reference herein, it can be advantageous to "tune" the mechanical response of a cushioning element in accordance with certain criteria, e.g., in order to influence the magnitude and rate of compression and recovery of the cushioning element when loaded by a wearer during use and thereby render the response of an article of footwear more in harmony with bodily movements: see U.S. Pat. No. 4,219,945; column 2, lines 1–5, and column 7, lines 47–52. In addition, Thomas McMahon teaches a biomechanically tuned shoe in U.S. Pat. No. 4,342,158, previously incorporated by reference herein. Differences in a runner's weight, running speed, and style can influence ideal values pertaining to the magnitude and rate of compression and recovery of a cushioning element.

ACCOMODATION TO ANATOMICAL DIFFERENCES

In the practical application of any or all embodiments of the present invention different individual users will likely require different conforming and supporting volumes of a conformable device in order to attain a desired conformance or fit. Accordingly, different quantities of light cure material can be required in some instances. This phenomenon is due to the wide variation in anatomical features and characteristics that exists amongst the general public. This practical problem can be overcome with the use of various devices, and methods.

REGULATE VOLUME DURING PRODUCTION

The quantity of light cure material present within a conformable device intended for a particular use can be regulated during production so as to accommodate for the volumes associated with differing anatomical features and characteristics. For example, the amount of light cure material 41 present within a conformable device **20*c*, as shown in FIG. 3**, and the like, could be regulated during production so as to accommodate for differing arch characteristics, and associated requisite volumes, i.e., high, normal and low arches or so-called flat feet. Further, it can be readily understood that other solid, liquid, or gaseous matter in partial or complete combination can be included with a conformable device. The quantity and associated volume of the light cure material, and any or all other materials or components used with a conformable device can similarly be substantially regulated or otherwise anticipated during production.

FOAMING/BLOWING AGENTS

The use of foaming or blowing agents with a light cure material can constitute another method to accommodate for varying anatomical features and characteristics, as different volumes can be displaced by a given quantity of a foamed or blown light cure material. The foamed or blown light cure material can comprise a resilient or relatively rigid material after a working or cure time, as desired. Shown in FIG. 40 is a representation of the resultant open-celled structure of a blown or foamed light cure material within conformable device 20*w*. Foaming or blowing agents can also serve to reduce the density and/or reduce the weight by volume of the end product. Foaming or blowing agents are generally classified as physical, or chemical blowing agents. Physical blowing agents function as gas sources by undergoing a change in a phase state. Physical blowing agents are largely related to the group of aliphatic hydrocarbons and their chloro- and fluoro-derivatives comprising isomers of pentane, hexane, heptane, fluorocarbons, trichlorofluoromethane, dichlorodifluoromethane, dichlorotetrafluoroethane, monochlorodifluoromethane, methylene chloride; carbon dioxide, nitrogen, and the like. Chemical blowing agents produce gas by a chemical reaction. Suitable chemical blowing agents are largely related to the group comprising sodium bicarbonate, dinitrosopentamethylene-tetramine, sulfonyl hydrazides, azodicarbonamide, p-toluenesulfonyl semicarbazide, 5-phenyltetrazole, diisopropylhydrazodicarboxylate, sodium borohydrite, and the like. The thermal range of decomposition of many commercial blowing agents can be lowered by the addition of activators or so-called kickers. Moreover, it should be noted that the presence of ordinary water serves as a foaming or blowing agent for many materials, e.g., urethanes, and polyurethanes. Obviously, it is necessary to properly engineer and coordinate the timing and quality of the foaming or blowing action with the desired working, setting or cure time of a selected light cure material.

ACCOMODATION VIA USE OF APPENDAGE

Figure 2:
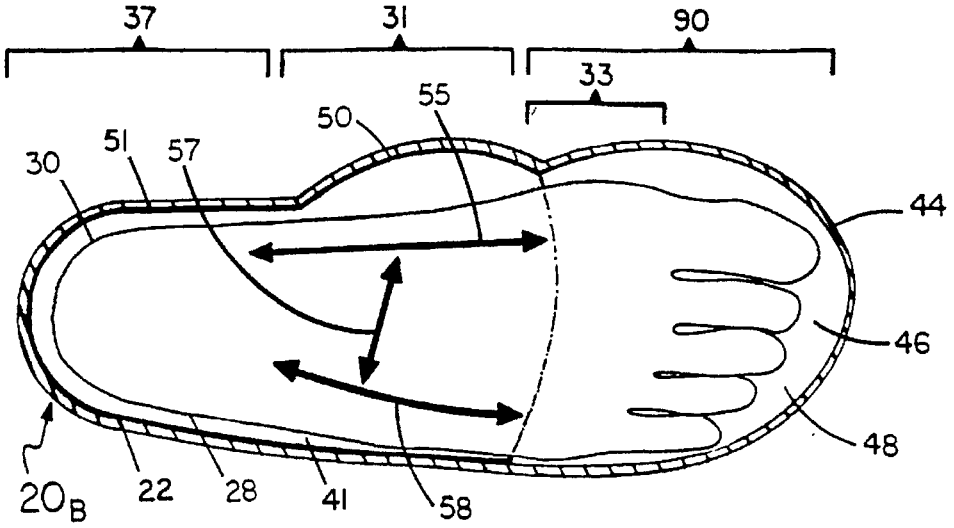
FIG. 2 is a top plan view of a conformable device for use in an article of footwear comprising a pliable casing and light cure material, and including an appendage located medially.

As shown in FIG. 2, the use of at least one appendage 50, and the like, in functional relation to a conformable device 20*b* can also accomodate for variations in the volume associated with the different anatomical features and characteristics found amongst a large percentage of the potential user population. An appendage 50 is generally formed by a pliable casing 22 which also forms at least one chamber 51 of conformable device 20*b*, and the like. When a conformable device 20*b* is positioned, e.g., in an article of footwear 44 and an application of pressure is made upon the conformable device 20*b* when a portion of the wearer's anatomy is inserted and secured, a quantity of the light cure material 41 can be displaced between chamber 51 and appendage 50. A known quantity of light cure material 41 (and any other form of matter included within chamber 51), which is known to accomodate the largest volume approximately required for an individual user possessing a particular size can then be introduced within the inner volume of a conformable device 20*b*, and the like, during production. An appendage 50 can then permit at least partial displacement and removal of a quantity of the light cure material 41, or other material (s) contained within the chamber 51 of conformable device 20*b*, and the like, and thus serve to substantially accommodate individual wearers who would require lesser quantities.

In some embodiments of the present invention light cure material, or other matter which is displaced into the appendage comprises non-functional excess matter and the appendage including any and all such matter can be excised, or otherwise removed from the chamber of a conformable device, and be simply discarded. However, it can be readily understood that the light cure material, or other matter possibly displaced between the chamber and appendage does not necessarily comprise so-called "excess" light cure material, or other matter, in various alternate embodiments of the present invention.

For example, a light cure material 41, or other matter can be displaced into an appendage 50 which is selectively located with respect to the chamber 51 and an article of footwear 44 so as to accomodate for the anatomical variation present in the general public in a desired manner, thus comprising a "smart" conformable device 20*b*, as seen in FIG. 2, and the like. Individual's having high arches will thereby be provided with improved support, as will wearer's having flat feet who will cause light cure material to be displaced about the medial side of the foot, as generally desired, in order to stabilize the condition of forefoot varus commonly associated with individuals having flat feet. In sum, displaced light cure material 41 can serve a useful purpose in some embodiments of the present invention and need not comprise excess matter.

Accordingly, it can be readily understood that a plurality of appendages of desired form and location can be used with alternate embodiments of a conformable device. In addition, it can be readily understood that an appendage can use at least one affixing surface to facilitate control of the inner volume of the appendage or to stabilize the appendage with respect to the conformable device, or an article of footwear with which the conformable device is to be used.

LIGHT SOURCES/METHODS/PROCESSES

As previously discussed, visible and ultraviolet light cure materials can be effectively cured in one quarter inch depth in direct sunlight in less than five minutes duration when contained within a relatively transparent pliable casing. In this regard, the cure time of ultraviolet light cure materials outdoors are less effected by the occurance of a cloudy day.

Incadescent, fluorescent, halogen, medium pressure mercury vapor, neon, laser, and other conventional lamps or light sources can also effect visible and ultraviolet light cure. However, conventional interior lighting generally does not exhibit substantial energy in the blue light spectrum, and the ultraviolet spectrum is nearly absent. Likewise, the glass windows and doors presently being used in residential homes substantially block ultraviolet light which can cause color fading of textiles, fabrics, and wood finishes. "Lighting Application Bulletin" published by the General Electric Company in April, 1989, illustrates the spectral power distribution curves of many conventional light sources and is attached to the present application, and is hereby incorporated by reference herein.

Accordingly, the applicant has engaged in testing and perfecting various light cure materials, light sources, methods, and processes in order to attain, e.g., desired cure times, physical and mechanical properties, shelf-life, and consumer compatibility. For example, the applicant obtained for experimental purposes small blue fluorescent lamps, ultraviolet lamps, and a suitable AC to DC invertor identified as "BXA-1201" to enable battery operation from J.K.L. Corporation of 13343 Paxton Street, Pacoina, Calif. 91331. The blue fluorescent lamps identified as "BF6165-12" measure approximately 6.49 inches in length and provide light having a spectral peak at 474 nanometers which renders them especially suitable to excite a photoinitiator such as "KT/37" which has a spectral peak absorbance at 470 nanometers. Similarly, the ultraviolet lamps identified as "BF959-UV1" measure under three inches in length and provide light having a spectral peak at 365 nanometers which renders them especially suitable to excite a photoinitiator such as that used in Dow Corning Corporation's OPTIGARD® Q3-6696 optical fiber coating. Again, this silicone elastomer cures in less than five seconds when exposed to 350 millijoules/cm2 of radiation from industrial ultraviolet lamps emitting wavelengths of approximately 350 nanometers. However, despite the fact that the above recited lamps exhibited desired wavelengths, they proved largely ineffective due to their relatively low light intensity level or spectral power.

It can then be readily understood that it is generally advantageous to use a higher intensity light source, e.g., one or more 40 watt fluorescent lamps, and preferrably a lamp providing the equivalent light intensity as conventional 80–200 watt lamps when expeditious cure of light cure materials is desired. It can be especially advantageous to utilize an aperatured fluorescent lamp to enhance light intensity. Custom made to order lamps of all kinds, e.g., visible and ultraviolet fluorescent lamps, can be obtained from L.C.D. Lighting of P.O. Box 3070, 11 Cascade Bvld., Millford, Conn. 06460, and Light Sources, Inc. of P.O. Box 3010, 70 Cascade Bvld., Millford, Conn. 06460. Technical materials made available by Light Sources, Inc. pertaining to visible and ultraviolet fluorescent lamps, neon lamps, and aperatured lamps are attached to this application, and are hereby incorporated by reference herein.

So-called full-spectrum fluorescent lamps which are available to the general public, e.g., four foot length 40 watt fluorescent lamps which provide at least approximately eighty-nine percent of the solar spectrum of a typical summer day, or alternately, 100–150 watt blue coated floodlight lamps can effect visible light cure, e.g., using the blue portion of the visible light spectrum. Full-spectrum fluorescent lamps are available in 40 watt, four foot lengths from Kelsun, 1300 Bel-Red Road, Bellevue, Wash. 98005.

Similarly, ultraviolet lights have also been available to the general public. However, the ultraviolet light spectrum is further divided into four sub-spectrums, vacuum UV (ultraviolet) corresponding approximately to wavelengths of less than 100 nanometers, UVC approximately corresponding to wavelengths of 100–280 nanometers, UVB 280–320 nanometers, and UVA to 320–400 nanometers. (Note: The visible light spectrum can extend between wavelengths of approximately 380–770 nanometers, therefor some might consider that an overlap between the ultraviolet and visible light spectrum exists at wavelengths between 380–400 nanometers. Further, some might consider that an overlap between the visible and infrared spectrum could possibly exist at the other extreme end of the visible light spectrum. Accordingly, for the purpose of more clearly delimiting and defining the spectral boundaries of electromagnetic radiation having wavelengths substantially corresponding to ultraviolet, visible, and infrared light and to avoid any possible confusion regarding the interpretation of this specification and the claims attached hereto: UVB and UVA light is hereby defined and understood to comprise wavelengths substantially between 280–400 nanometers, and visible light is hereby defined and understood to comprise wavelengths substantially between 400–750 nanometers.) Special care and precautions must be exercised when using ultraviolet light, as UVC and UVB ultraviolet light is capable of inducing skin cancer and blindness. The use of UVC, or substantial UVB ultraviolet light is then limited to those conditions in which appropriate measures have been taken to safeguard human health.

UVB and UVA radiation is that portion of the UV spectrum generally associated with sun tanning, both in natural sunlight and in tanning beds. UVA ultraviolet light sources are generally available to the public as "black lights," commonly used to illuminate posters. UVA "black lights" are available in 40 watt, four foot lengths from Kelsun, 1300 Bel-Red Road, Bellevue, Wash. 98005. These "black lights" commonly have a spectral power peak between 350–365 nanometers and provide little or no UVB or UVC light. The applicant has cured Dow Corning's OPTIGARD® ultraviolet light cure material in one eight to one quarter inch depth in less than three minutes using such "black lights." Aperatured 40 watt fluorescent ultraviolet lamps in two foot length are presently being utilized by the applicant in a light table 120, as shown in FIG. 44, and have demonstrated cure of light cure materials to one quarter inch depth in less than one minute. More powerful ultraviolet lamps commonly used in tanning beds are also available from Light Sources, Inc., e.g., their BL 26 series ultraviolet lamp emitting UVA and UVB light is available in 59–74 inch lengths and 85–180 watts.

Figure 47:
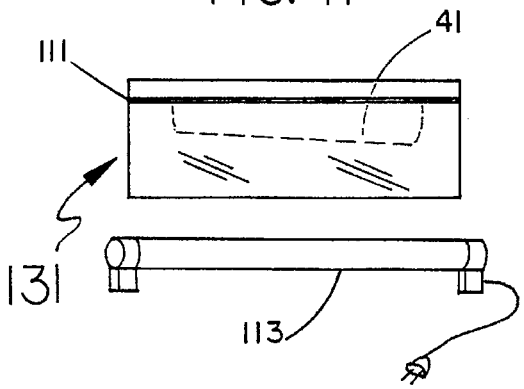
FIG. 47 is a cross sectional side view of a substantially transparent mold containing a light cure material, also shown is a light source.

For effecting cure of light cure materials within a matter of seconds in a manufacturing and production setting, e.g., for curing light cure materials contained within a transparent mold 131, as shown in FIG. 47, a modular ultraviolet curing system such as those manufactured by UVEXS Incorporated of 580 Pastoria Avenue, Sunnyvale, Calif. 94086 can be advantageous. In particular, medium pressure mercury vapor lamps used in configurations "B" and "C," as illustrated in UVEXS technical materials previously incorporated by reference herein, can be advantageous when ultilizing polymer molds, e.g., a mold made of transparent polyester casting resin, which may have a limited tolerance to high temperatures. Again, appropriate precautions to safeguard human health should be observed when using powerful ultraviolet lamps, and in particular, those emitting substantial UVB or UVC radiation. For further information contact the American Conference of Governmental Industrial Hygienists, 6500 Glenway Avenue, Building D-7, Cincinnati, Ohio 45211, and see the publication entitled: 1992–1993 *Threshold Limit Values for Chemical Substances and Physical Agents and Biological Exposure Indices,* 1992, pages 124–127 being attached hereto, and hereby incorporated by reference herein.

It can be readily understood that the use of reflective materials in association with lamps such as mirrored surfaces or coatings, cold mirrors, aperatured lamps, filters, and suitable coordination of other lamp or optical components can be optimized to provide the intensity or brightness associated with desired levels of light energy to effect light cure as desired.

REFLECTIVE MATERIAL/OTHER AIDS

The inclusion of a reflective material, e.g., a reflective plastic or metallic foil, a conventional mirror, a concave mirror, a cold mirror, and other devices commonly known in the field of optics including prisms, lenses, filters, polarized materials, and diffraction gratings can be used as desired for the implemention of light cure. These devices or materials, as well as fiber optical materials can be obtained, e.g., from the Edmund Scientific Company of 101 East Gloucester Pike, Barrington, N.J. 08007. Relevant excerpts of the 1993 Edmund Scientific Company have been attached to this application, and are hereby incorporated by reference herein.

The inclusion of a reflective material 111, as a device and method for enhancing the use of available light is shown in FIG. 47. This can increase the effective light energy available to excite a suitable photoinitiator and thereby induce setting of a light cure material. Obviously, it is advantageous to position the reflective material in a manner generally opposing the direction of the penetrating light or light source.

LIGHT TABLE

One device and method for effecting light cure of suitable materials about a portion of an individual's anatomy, and in particular the plantar surface of an individual's foot, is with the use of a light table 120, as shown in FIG. 44. The individual essentually stands on a substantially transparent support surface 112, e.g., made of glass, PLEXIGLAS®, LEXANE®, or acrylic material, and the like, with a suitable conformable device 20*c*, and the like, positioned under the foot 28. The light source 113 is then activated causing the light cure material 41 contained within the conformable device 20*c* to set and cure. Aperatured 40 watt fluorescent ultraviolet lamps in two foot length are presently being utilized in a light table 120, as shown in FIG. 44, and have demonstrated cure of light cure materials to one quarter inch depth in less than one minute. Not shown is the possible use of a reflective material in a superior position relative to the conformable device 20*c*. The light table 120 can include a fan and ventilation means for maintaining an operating temperature as desired, and other optical devices as discussed above (not shown). Substantially transparent PLEXIGLAS®, LEXANE®, or acrylic material, and the like, is generally lighter, less expensive, easier to cut or shape, and can be unbreakable relative to glass.

However, synthetic transparent materials of this general type in one quarter or one half inch thicknesses commonly transmit approximately 80–95 percent of the available light, whereas glass can approach 100 percent light transmission. Further, synthetic transparent materials or glass can contain ultraviolet light inhibitors which block the transmission of ultraviolet light, thus care must be taken in selecting suitable materials for effecting cure with ultraviolet light.

DEVICES/METHODS FOR INTRODUCING LIGHT INTO AN ARTICLE OF FOOTWEAR

As discussed above, various devices and methods exist for inducing cure of a conformable device including or substantially comprising a light cure material, outside of an article of footwear. However, it can be advantageous to effect light cure when a conformable device is positioned in functional relation to an article of footwear. In particular, this can provide conformance to portions of a wearer's anatomy in relation to the interior of an article of footwear.

OPENINGS/TRANSPARENT MATERIALS

Figure 36:
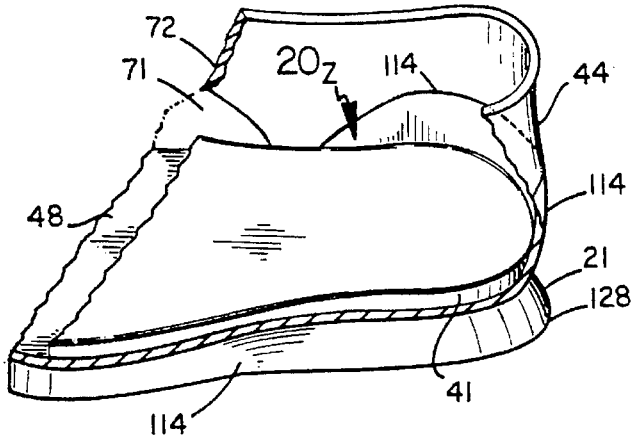
FIG. 36 is a perspective view representing a conformable device being used with an article of footwear having transparent shoe upper and sole portions.

One device and method for permitting the penetration of light is an opening 71, or transparent material 114 located proximate a conformable device 20*z*, as shown in FIG. 36. Again, a transparent material 114 having a particular desired color can be selected in order to facilitate visible light cure. Articles of footwear having partial or completely transparent uppers 72 for enveloping a wearer's foot, ankle and lower leg are known in the art. Further, articles of footwear having openings 71 in the sole, and articles of footwear having transparent material 114 sole portions, including air bladders and midsoles, whether in partial or complete combination, are also known in the art. However, to the best of the applicant's knowledge, the use of openings or transparent materials in articles of footwear for the purpose of facilitating cure of a light cure material is not known in the prior art.

ELECTROLUMINESCENT LAMPS

Figure 45:
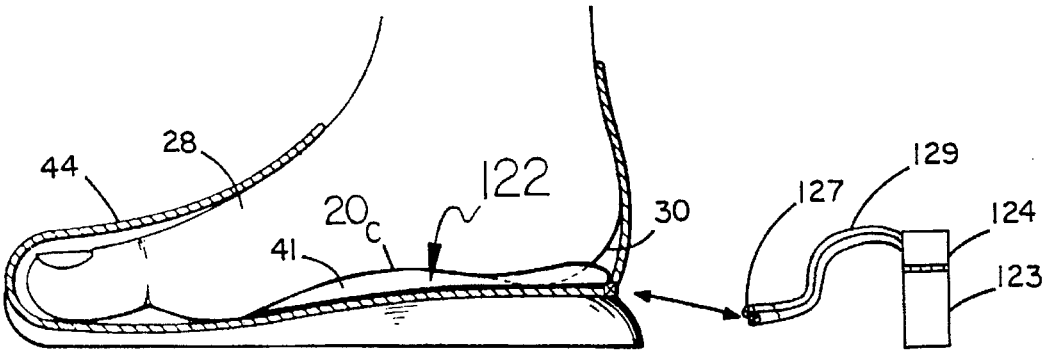
FIG. 45 is a cross sectional side view of an electroluminescent lamp positioned adjacent a conformable device, and shown in relation to an article of footwear.

A further method or device for introducing a light source into an article of footwear for effecting light cure is the use of an electroluminescent lamp 122, and the like, as shown in FIG. 45, e.g., DUREL 3® electroluminescent lamps made by the Durel Corporation, an affiliate of 3M and Rogers Corporation, of 645 West 24th Street, Tempe, Ariz. 85282. Technical information pertaining to DUREL 3® lamps has been attached to this application, and is hereby incorporated by reference herein. Advantages of electroluminescent lamps include their flexibility and thin cross-section enabling such devices to be selectively removable. Such lamps generally require an AC power source, but DC batteries 123 can be used to power such lamps with the use of a suitable invertor device 124. Suitable invertors are made by Endicott Research Group, Inc. of P.O. Box 269, 2601 Wayne Street, Endicott, N.Y. 13760. It is possible to permanently position an electroluminescent lamp and suitable power source within an article of footwear, or alternately permanently position the electroluminescent lamp portion and provide at least one selectively attachable electrical connection 127, and means for providing power, e.g., a power cord 129 including a plug 125. Further, it is possible to use a removable electroluminescent lamp in relation to an article of footwear with or without a permanently attached power source.

FIBER OPTIC MATERIALS

Figure 46:
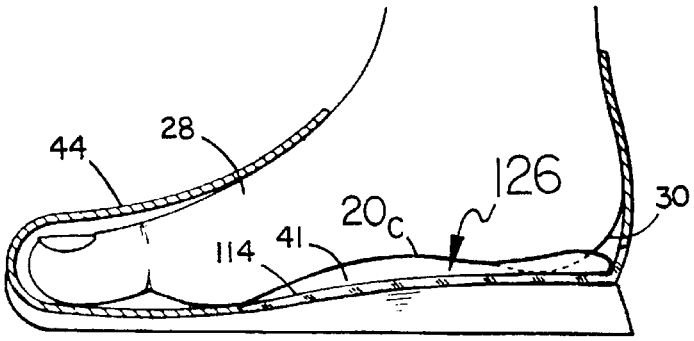
FIG. 46 is a cross sectional side view of a fiber optic material, e.g., strands or ribbon, positioned adjacent a conformable device, and shown in relation to an article of footwear.

A further method and device for introducing suitable light into an article of footwear 44 is a fiber optic material 126, as shown in FIG. 46. Fiber optic strands can be at least partially jacketed, or unjacketed. Light can thereby be emitted along the length of fiber optic strands, or at the ends of the fiber optic strands. Light can be made to "leak" from the surface of fiber optic ribbon comprising, e.g., approximately 0.02–0.03 inch diameter glass fibers adhesive-bonded to approximate 400 fibers per inch, when the fiber optic ribbon is abraded or hot stamped. Fiber optic materials are available to the general public, e.g., relevant excerpts of the 1993 Edmund Scientific Company catalogue are attached to this application, and have been previously incorporated by reference herein.

Fiber optic strands or ribbon, and the like, can be positioned proximate a conformable device 20*c*, and the like, in a removable, or permanent relation to an article of footwear 44, as desired. A suitable light source can either then be directed towards, or more directly transmitted through the fiber optic material 126 in order to effect the cure of a light cure material 41 within an article of footwear 44.

REMOVAL AND REPLACEMENT

Again, as shown in FIG. 4, one side, or both sides (not shown) of conformable device 20*d* can employ a peel-away protective release material 36 that can serve to expose a self-adhesive surface 38 for removably affixing a conformable device 20*d*, and the like, within an article of footwear. The preferred adhesive being used at the present time is a "pressure sensitive" product that permits removal and replacement of conformable device 20*d* if ever necessary. SCOTCH-MOUNT® double coated foam adhesive tapes manufactured by the 3M Company, St. Paul, Minn., are being used at the present time, and in particular, 3M tape No. 4484, a white polyethylene foam tape with a thickness approximately of 1/16th or 0.063 inches, although other materials are contemplated. It is advantageous that such materials and products have a temperature resistance meeting or exceeding approximately 100–120 degrees Fahrenheit, demonstrate resistance to solvents, in particular water, and have high adhesive qualities. A foam tape with a thickness approximately of 0.031–0.063 is preferred for use with a conformable device in most footwear applications in order to accommodate for irregularities between the surfaces to be joined. In some cases, a thinner double-coated adhesive tape can be used to affix a conformable device. Moreover, the 3M Company manufactures adhesive tapes having specific bonding characteristics with reference to the particular material surfaces to be affixed.

Figure 22:
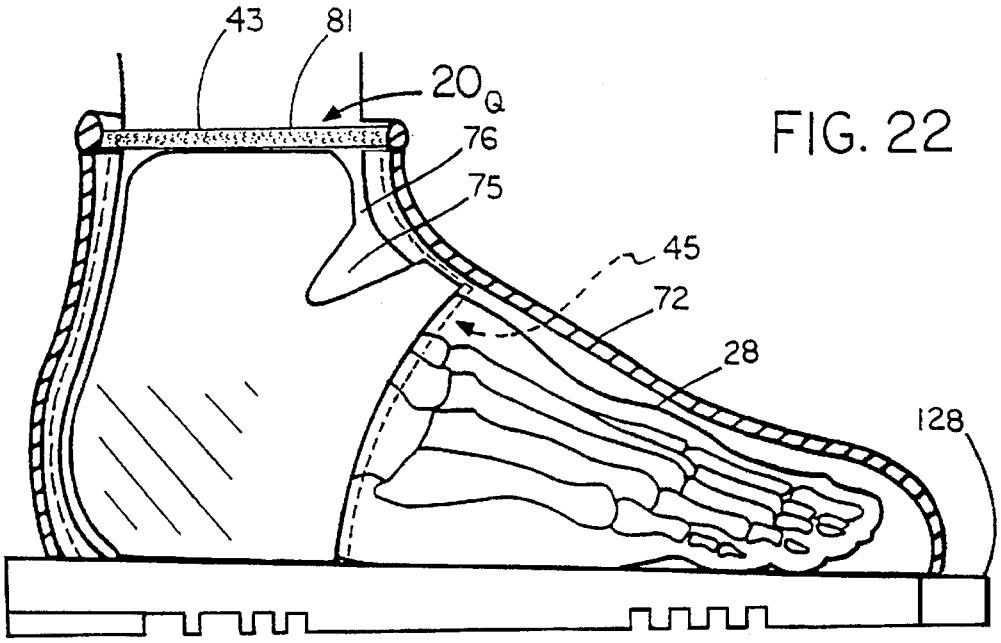
FIG. 22 is a lateral view of a conformable device that is in communication with the lateral, medial, and superior or dorsal aspects of a wearer's foot showing a notched area about the distal aspect of the wearer's leg and superior aspect of the foot generally anterior to the lateral and medial malleolii for permitting plantar flexion and dorsi flexion of the foot.
Figure 37:
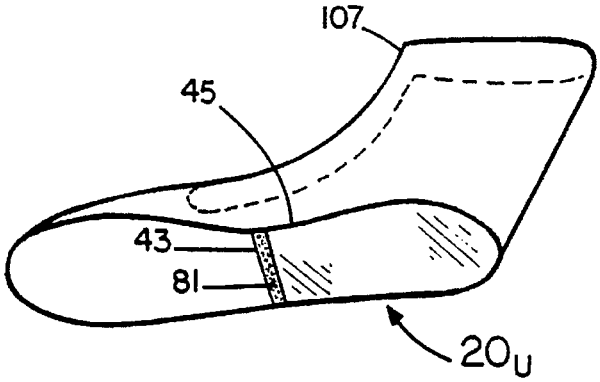
FIG. 37 is a perspective view of a conformable device used in functional relation with the inner boot or liner of an article of footwear showing a compartment for positioning the conformable device and closure means.

It can be readily understood that a conformable device can be pre-positioned or affixed within an article of footwear during manufacture. Further, as shown in FIGS. 22 and 37, conformable devices 20*q* and 20*u*, respectively, and the like, can be positioned by a user within an article of footwear 44 via an access point 43 to a pocket or compartment 45, and as desired, be secured by other conventional affixing means, e.g., VELCRO® hook and pile 81, or (not shown) a zipper, snap, self-adhesive surface, and the like. Frictional mating surfaces or complimentary structural mating surfaces can also be used to affix a conformable device in relation to an article of footwear.

Generally, it is advantageous to cause the light cure material associated with a conformable device to be caused to cure while the conformable device is positioned in functional relation to a portion of a wearer's anatomy. However, an alternate method is to utilize a highly viscous foam material which exhibits delayed recovery and/or highly viscous light cure material that will substantially retain to shape imparted to the light cure material and/or conformable device by a wearer for a period of time necessary and sufficient to effect the cure of a light cure material.

STORAGE/PACKAGING/ISOLATION FROM LIGHT

Figure 27:
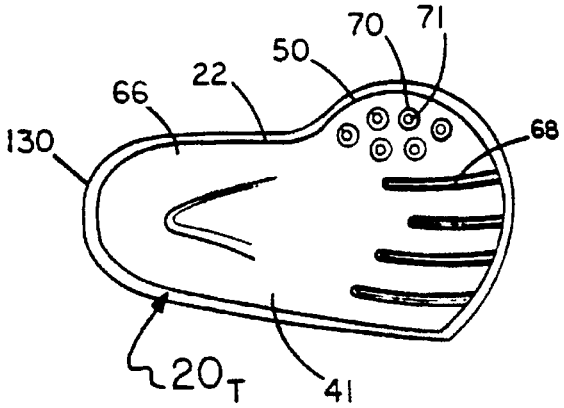
FIG. 27 is a top plan view of a conformable device showing the use of a medially located appendage including a structural pattern and the use of openings for the ventilation of matter, and also showing the use of a selectively removable barrier material to visible and ultraviolet light.

As shown in FIG. 4, the pliable casing 22 can utilize a removable protective release material 36 having an adhesive backing 38 which when removed can be used to affix the conformable device 20*d* as desired in an article of footwear. Moreover, a protective release material 36 can also permit the exposure of the conformable device 20*d* to a suitable light source. As shown in FIG. 27, a conformable device 20*t* can be sealed in an envelope, container, or otherwise be selectively isolated by conventional means during storage, e.g., utilizing a barrier material 130 to visible and ultraviolet light. Conventional means known to those in the packaging industry include the use of barrier plastic materials, metallic foils, polarized materials, and generally, those devices and means utilized in the protection of photographic film, and the like. Obviously, such barrier devices and methods can be used alone, or in partial or complete combination.

MANUFACTURING AND PRODUCTION

Again, the present invention anticipates the possible use of light cure technology in the manufacture and production of various component parts of articles of footwear, e.g., the making of resilient foam midsoles or soles, and shoe uppers. Presently, conventional manufacturing processes are relatively energy, labor, and material intensive, as compared with possible light cure methods and processes. For example, the forming of a conventional resilient foam shoe midsole commonly requires a cycle time of 5–7 minutes in a mold imparting both considerable heat and pressure. It is possible to introduce suitable light cure materials within a suitable glass, or alternately, a substantially transparent resin or polymer mold, e.g., polyester, nylon, polycarbonate, acrylic, and the like, and to subsequently effect cure using a suitable light source. When using ultraviolet light care must be taken to utilize a quartz glass material, and the like, or a synthetic material which will readily transmit ultraviolet light. The cure time of a light cure material using industrial high intensity ultraviolet, or visible light can comrpise fractions of a second, and certainly, cure times of less than one minute are relatively easy to obtain. This can provide a dramatic decrease in cycle times, lower operating temperatures and considerable energy savings. Further, it is possible to select a suitable blowing or foaming agent having relatively low temperature activization, or coordinate the use of suitable activators or "kickers" therewith to yield a foamed light cure material. The use of optical devices and reflective materials, as described above, can enhance the effectiveness of light cure manufacturing and production processes. Further, it would clearly be possible to use robotics or otherwise mechanize or accelerate the production process with regards to the manufacture of footwear components, and the like, in association with light cure materials. For example, a production system could generally utilize the following steps or method, or their equivalent:

1) a suitable mold for effecting light cure is opened;
2) optionally, a release agents is sprayed into the mold;
3) the mold is filled with a predetermined quantity of light cure material, and any other desired components;
4) optionally, the mold environment is maintained at controlled atmospheric conditions, e.g., temperature;
5) optionally, the light cure material includes a suitable blowing or foaming agent and the activity of this agent is coordinated with the engineered working or cure time of the light cure material;
6) the mold is closed and sufficient force is applied to maintain closure;
7) optionally, the blowing or foaming of the light cure material proceeds as desired;
8) the light cure material within the mold is suitably exposed to an appropriate light source for effecting the engineered working or cure time;
9) the mold is opened and the component is removed;
10) continue as desired in a closed loop to step 2 and proceed through step 10.

It can be readily understood that the above method and process could reduce the time, energy, and cost of manufacturing and producing articles of footwear or components thereof.

Again, in order to effect cure of ultraviolet light cure material 41 within a matter of seconds in a manufacturing and production setting, e.g., such as within a mold 131 which is substantially transparent, at least in part, as shown in FIG. 47, a modular ultraviolet curing system such as those manufactured by UVEXS Incorporated of 580 Pastoria Avenue, Sunnyvale, Calif. 94086 can be advantageous. In particular, medium pressure mercury vapor lamps used in configurations "B" and "C," as illustrated in UVEXS technical materials previously incorporated by reference herein, can be advantageous when ultilizing polymer molds, e.g., a mold made of transparent polyester casting resin, which have a limited tolerance to high temperatures. Again, appropriate precautions to safeguard human health should be observed when using powerful ultraviolet lamps, and in particular, those emitting UVB or UVC radiation.

SPECIFIC EMBODIMENTS OF A CONFORMABLE DEVICE

As shown in FIG. 1, conformable device 20*a* for customizing the footbed 48 of an article of footwear 44 at least partially underlies the plantar aspect of a wearer's foot 28, in particular, the area underlying the rearfoot 37 and midfoot 31, thus providing support to the arches of the foot 28. The wearer's foot 28 then generally "bottoms out" and is supported in an article of footwear 44 without substantial quantities of light cure material 41 being present in the area underlying the heel 30 or metatarsal heads 25 located in the ball 33 of the foot 28. The fit of the wearer's foot in relation to the substantially form-defining last of the article of footwear is thereby not adversely affected. Further, a conformable device 20*a* used in the area of the footbed 48 can enhance conformance and thereby increase the effective area of the midsole 21 used to attenuate force applications. Therefore, it is generally possible for a user to enjoy superior cushioning effects with the use of a conformable device 20*a*, or alternately, for footwear midsole elevations to be decreased in the production of articles of footwear 44, at least in part, without compromising a given level of cushioning quality. Decreased heel elevations can be associated with improved footwear stability. Also shown in FIG. 1, are bones of the foot 28 including the calcaneus 83, talus 84, navicular 85, cuboid 86, three cuneiforms 87, metatarsals 88, phalanges 89, and the general area(s) of the metatarsal heads 25, rearfoot 37, midfoot 31, ball of the foot 33, and forefoot 90.

Conformable device 20*a*, and the like, can be placed in functional relation to a light table 120, or alternately, an article of footwear 44 including, e.g., openings 71, transparent materials 114, or fiber optic material 126, to effect exposure to a visible or ultraviolet light source such as the sun, or a conventional man-made light source 113. Alternately, an internal light source 113 can be used in functional relation to a conformable device 20*a*, and the like, to effect visible or ultraviolet light cure, e.g., an electroluminescent lamp 122, and the like.

In any event, when a wearer's foot is positioned in functional relation to conformable device 20*a*, a force application is made thereupon causing light cure material 41 to be formed in conformance with the wearer's foot. The light cure material 41 can then be caused to set and cure using a suitable visible or ultraviolet light source thereby causing the shape imparted to the conformable device 20*a* to be substantially retained, thus giving to the end product a "permanent memory" capability.

Shown in FIG. 2 is a conformable device 20*b* including an appendage 50 located about the medial aspect of the midfoot 31. The appendage 50 can be used to accomodate the displacement of light cure material 41 from the chamber 51 of conformable device 20*b*, and at the same time can provide support to the medial side of the foot. Generally, an individual having flat feet will displace more light cure material 41 into the medially positioned appendage 50. However, since such an individual normally requires greater medial support in the midfoot area due to the presence of a forefoot varus condition, a conformable device 20*b*, and the like, can perform in a "smart" manner exhibiting functional adaptability to varying anatomical characteristics. Also shown in FIG. 2, are the areas of the foot generally corresponding to the medial longitudinal arch 55, lateral longitudinal arch 58, and transverse arch 57.

As shown in FIG. 3, a foam material 66 can be used, as discussed above, within a conformable device 20*c*, and the like. Again, it is generally advantageous to affix one side of the foam material 66 to the pliable casing 22 on that side opposing the direction of the penetrating light.

As shown in FIG. 4, an overlying insole or sockliner 46 can be affixed by conventional means to a conformable device 20*d*. Further, an overlying material or sockliner 46 can be affixed in such a manner as to serve as a functional member for enclosure of a conformable device 20*d*. A self-adhesive surface 38 protected by a peel-off protective backing 36 is shown on the inferior surface of conformable device 20*d* for selectively affixing the same in functional relation to an article of footwear. Also shown in FIG. 4, is the use of an open-celled foam material 66 and a light cure material 41 within conformable device 20*d*. Further, a relatively transparent open-celled foam material 66 can be used within conformable device 20*d*, and the like, for permitting better transmission of visible or ultraviolet light.

Figure 5:
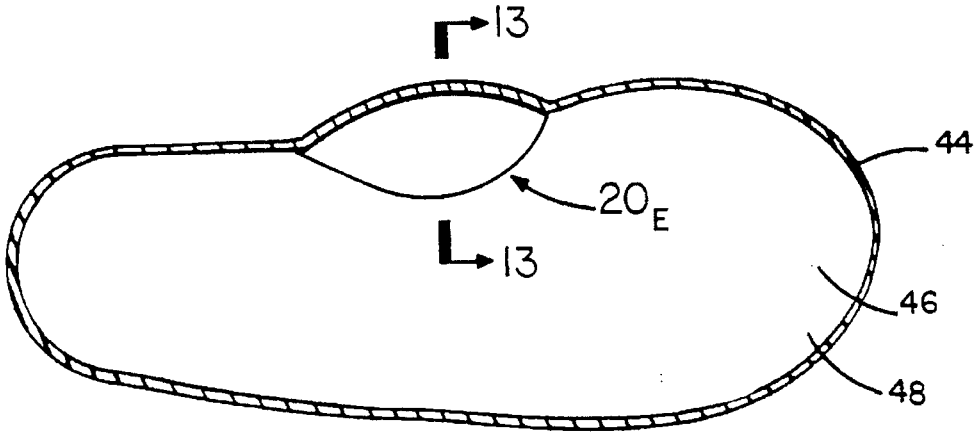
FIG. 5 is a top plan view of a conformable device for supporting the medial longitudinal arch of a wearer's foot.

As shown in FIG. 5, conformable device 20*e* can be used in a select area with respect to the sockliner 46 or footbed 48 of an article of footwear 44. Conformable device 20*e* can substantially support at least a portion of the wearer's medial longitudinal arch 55 and transverse arch 57, and if desired, at least a portion of the medial area of the midfoot 31.

Figure 6:
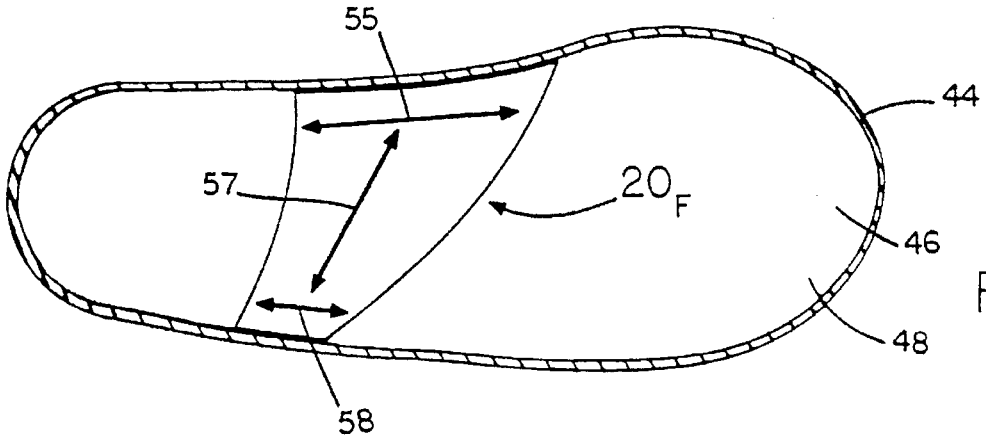
FIG. 6 is a top plan view of a conformable device for supporting the medial longitudinal, lateral longitudinal, and transverse arches of a wearer's foot.

As shown in FIG. 6, conformable device 20*f* can be used in a portion of a sockliner 46 or footbed 48 of an article of footwear 44 and can support at least a portion of the wearer's medial longitudinal arch 55, lateral longitudinal arch 58, and transverse arch 57.

Figure 7:
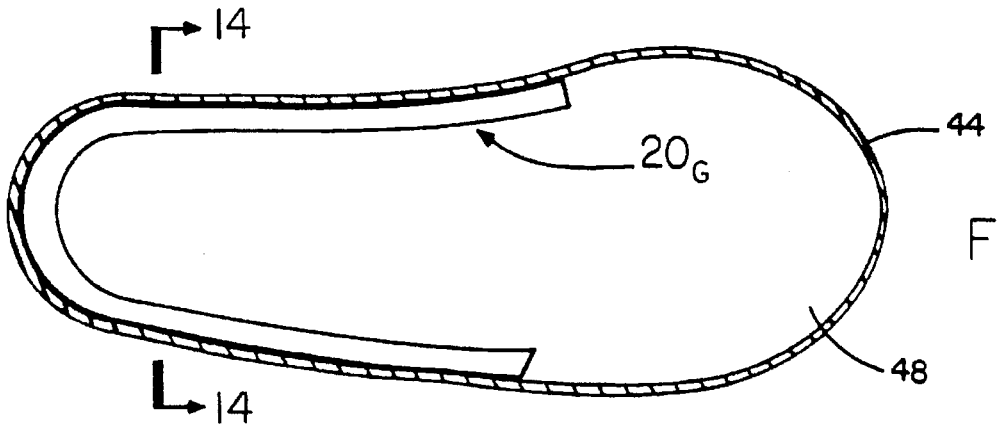
FIG. 7 is a top plan view of a conformable device for use about the medial, posterior and lateral perimeter of a wearer's foot.

As shown in FIG. 7, conformable device 20*g* can be used about the medial, lateral, and posterior perimeter of a wearer's foot 28. It can be readily understood that an alternate conformable device can be used about a portion or portions of the medial, lateral, and posterior perimeter of the wearer's foot, whether in partial or complete combination. Further, an alternate conformable device can exhibit symmetry or asymmetry between medial and lateral sides. Conformable device 20*g*, and the like, can provide support to and enhance the stability of a wearer's foot 28 within an article of footwear 44. In addition, a conformable device 20*g*, and the like, can provide enhanced conformance or fit.

Figure 8:
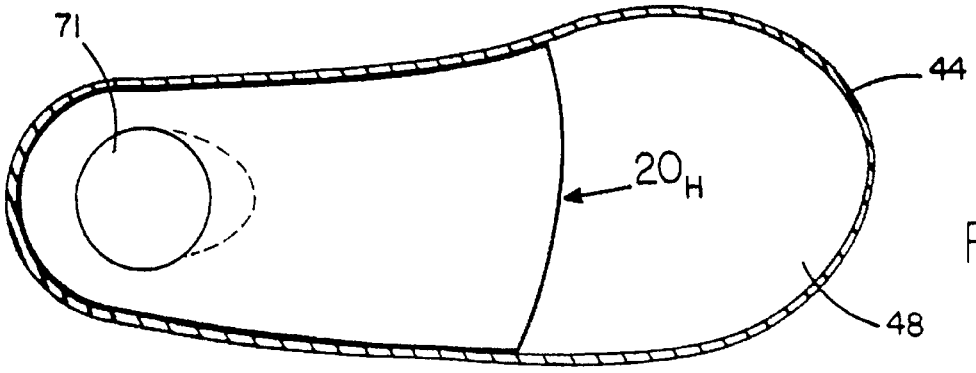
FIG. 8 is a top plan view of a conformable device for use in the footbed of an article of footwear showing an opening in the area underlying a wearer's heel.

As shown in FIG. 8, conformable device 20*h* can include an opening 71 in the area about the plantar aspect of a wearer's heel 30, thus enabling the wearer's heel 30 to be positioned proximate to an underlying and supporting surface within an article of footwear 44. This configuration can contribute to positioning and stabilizing a wearer's rearfoot 37 in relation to an article of footwear 44, and can accomplish these tasks without further elevation of the wearer's heel.

As shown in FIG. 9, a cross-sectional view of conformable device 20*c* of FIG. 3 along line 9—9 shows the conformable device 20*c* formed in a cupped formation about the medial and lateral sides, or inferior perimeter of the wearer's foot 28. This cupped formation can contribute to stabilizing the wearer's foot 28 in relation to an article of footwear 44 and can enhance conformance or fit. It can be readily understood that this concave cupped formation can be used with other embodiments of the present invention. Also represented is the coordination of a closed-cell foam material 66 having raised contours 68 thereupon, with the use of a light cure material 41 for effecting desired physical and mechanical properties in various portions of conformable device 20*c*.

Figure 10:
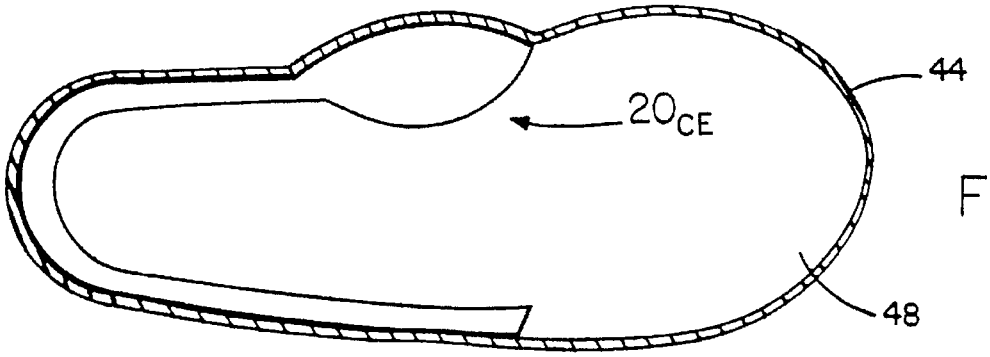
FIG. 10 is a top plan view of a conformable device resembling a combination of those shown in FIGS. 5 and 7.

As shown in FIG. 10, a conformable device 20*ce*, which resembles a combination of conformable device 20*c*, and conformable device 20*e* can be formed to perform the functions associated with both of these embodiments.

As shown in FIG. 11, an asymmetrical structural pattern 70 can be used in defining the form and selective reinforcement of conformable device 20*j*, and the like. An asymmetrical structural pattern can be used in recognition of the fact that applications of force upon the conformable device can be non-uniformly applied to a portion or portions of a conformable device, thus possibly necessitating a non-uniform or asymmetrical structural pattern for selective reinforcment of a conformable device. Also shown, is the possible use of an opening 71 formed by the structural pattern 70 for the ventilation of matter through conformable device 20*j*, but in isolation from the inner volume of the conformable device 20*j*.

Figure 12:
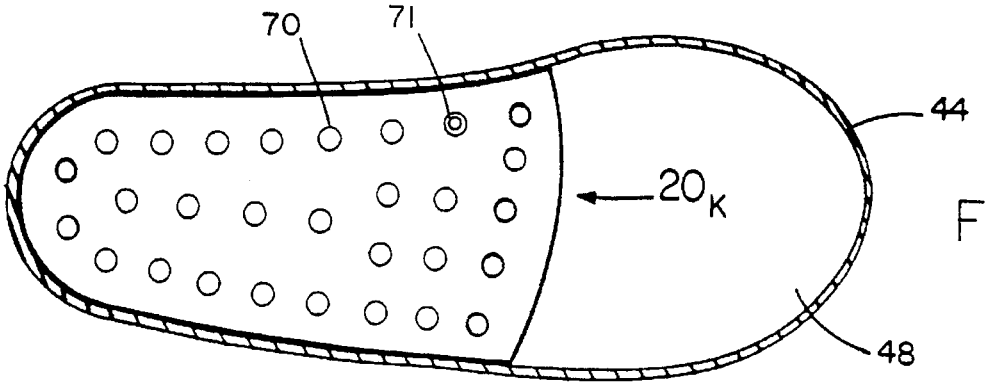
FIG. 12 is a top plan view of a conformable device showing opposing members of pliable casing joined in a symmetric structural pattern.

As shown in FIG. 12, a symmetrical structural pattern 70 can be used to substantially define the form and selective reinforcment of a conformable device 20*k*, and the like. A symmetrical structural pattern can provide simple selective reinforcement of a conformable device. Also shown, is the possible use of an opening 71 formed by the structural pattern 70 for the ventilation of matter through conformable device 20*k*, but in isolation from the inner volume of the conformable device 20*k*.

Figure 13:
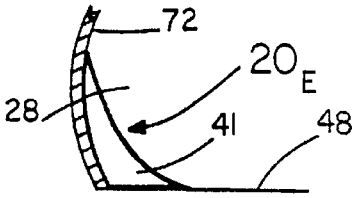
FIG. 13 is a cross-sectional view along the medial-to-lateral axis of the conformable device of FIG. 5, along line 13—13.

As shown in FIG. 13, a cross-sectional view of the conformable device 20*e* of FIG. 5 along line 13—13 shows conformable device 20*e* supporting a medial portion of the wearer's foot 28 including the medial longitudinal and transverse arches of the foot in a cupped formation. This can enhance conformance or fit, comfort, and support to the medial aspect of the foot.

Figure 14:
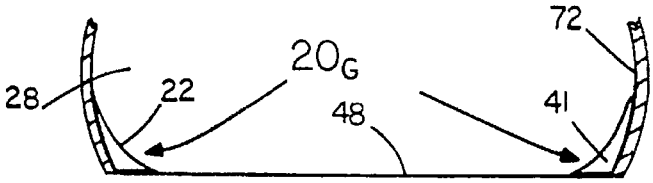
FIG. 14 is a cross-sectional view along the medial-to-lateral axis of the conformable device of FIG. 7, along line 14—14.

As shown in FIG. 14, a cross-sectional view of the conformable device 20*g* of FIG. 7 along line 14—14 shows cupped formations about the medial and lateral inferior perimeter of a wearer's foot 28. Again, this can enhance conformance or fit, comfort, and provide support to both the medial and lateral aspects of the foot.

As shown in FIG. 15, a conformable device 20L can be used to enhance conformance or fit, and provide support to the lateral aspect of a wearer's foot 28 in the area about the lateral malleolus 63. Conformable device 20L can serve to protect the wearer in the area of the lateral malleolus 63 from direct force applications, and in combination with the footwear upper 72 can resist inversion of the foot 28 and possible injury to the lateral collateral ligament(s), i.e., the anterior talofibular ligament, the posterior talofibular ligament and the calcaneofibular ligament.

Figure 16:
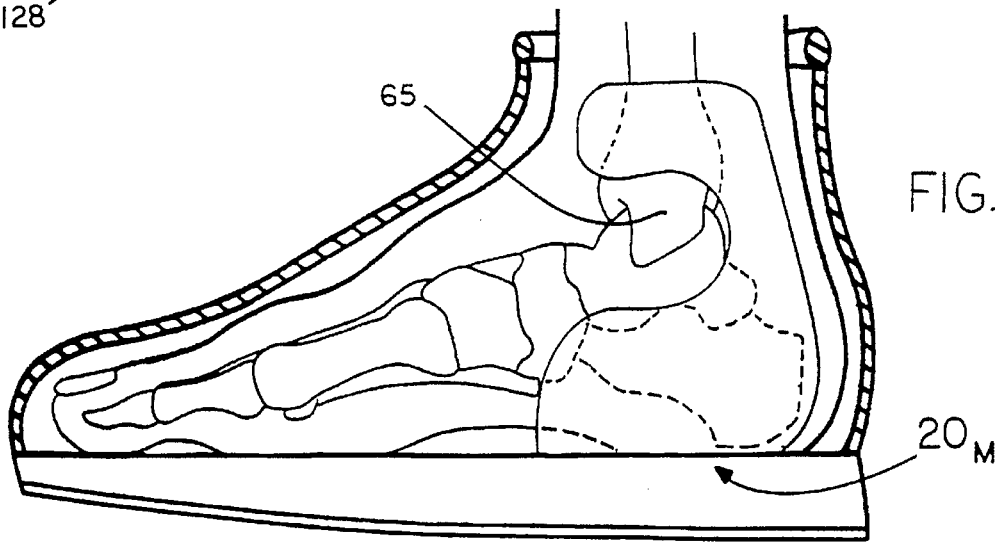
FIG. 16 is a medial view of a conformable device for use in an article of footwear located in the area about the medial malleolus showing the relation of the conformable device to various bones of a wearer's foot.

As shown in FIG. 16, a conformable device 20*m* can be used to enhance conformance or fit and provide support to the medial aspect of a wearer's foot 28 in the area about the medial malleolus 65. Conformable device 20*m* can serve to protect the wearer from direct force applications in the area about the medial malleolus 65, and in combination with the footwear upper 72 can resist eversion of the foot 28 and possible injury to members of the deltoid ligament(s), i.e., the anterior tibiotalar, posterior tibiotalar, tibiocalcaneal, and tibionavicular ligaments.

Figure 17:
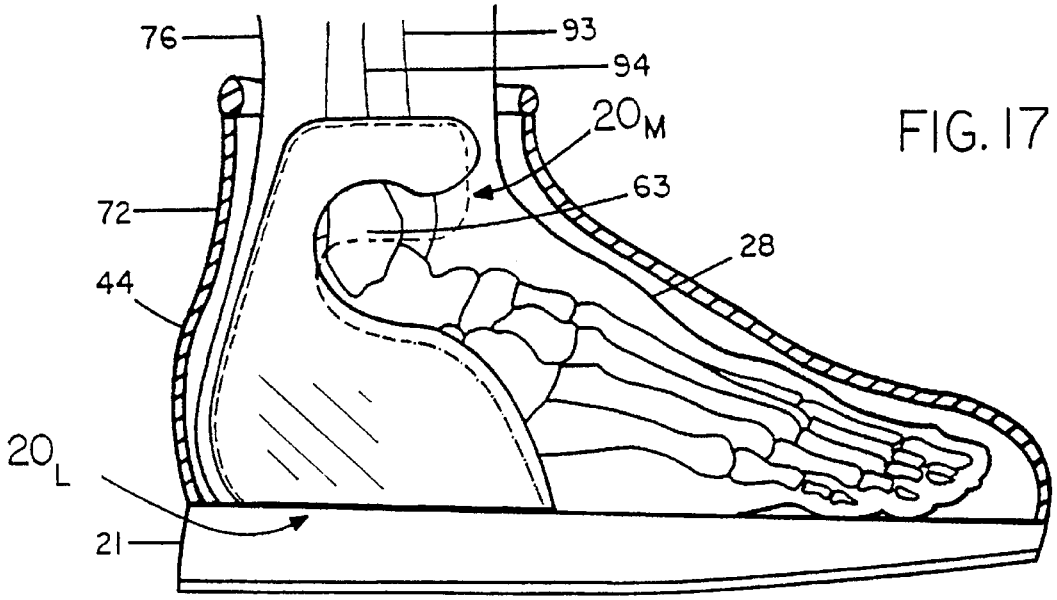
FIG. 17 is a superimposed view of the conformable devices of FIGS. 15 and 16 showing the presence of asymmetry between the lateral and medial embodiments.

As shown in FIG. 17, a superimposed view of the conformable devices 20L and 20*m* of FIGS. 15 and 16 shows the presence of asymmetry between the lateral and medial embodiments of the conformable devices 20L and 20*m*. The center of the medial malleolar protuberance is typically 2 centimeters anterior and approximately 2.5 centimeters superior to the center of the lateral malleolar protuberance in an adult wearing a size 9 article of footwear. (See John Robinson, et. al., U.S. Pat. No. 4,876,806, hereby incorporated by reference herein.) Allowance for medial and lateral asymmetry in the configuration of conformable devices 20L and 20*m* can enhance fit and comfort.

Figure 18:
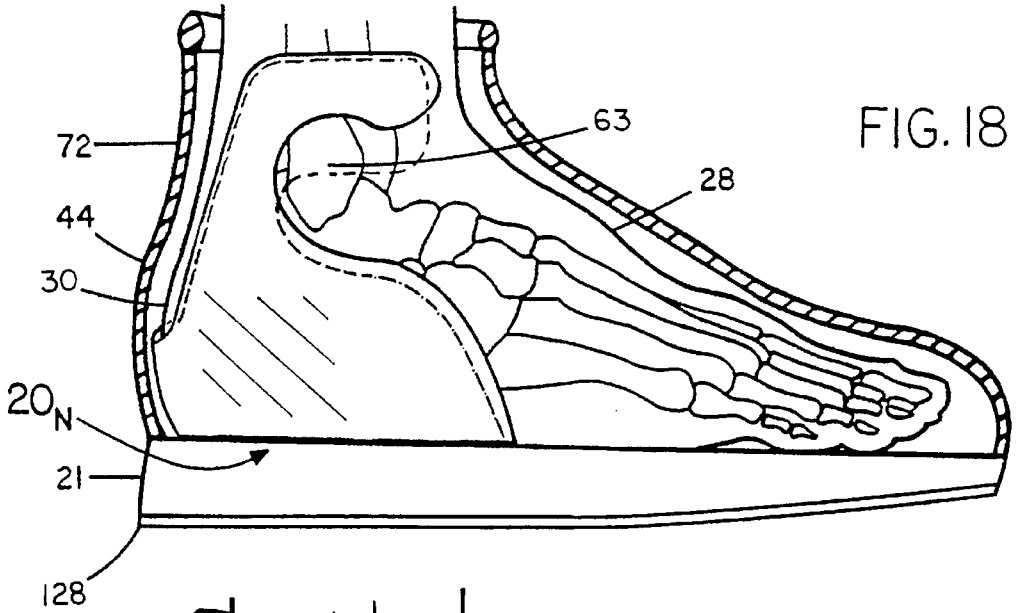
FIG. 18 is a lateral view of a single conformable device resembling a combination of FIGS. 15 and 16, but also showing continuity about the heel of the wearer's foot.

As shown in FIG. 18, a conformable device 20*n* similar to FIGS. 15 and 16 can be formed in a single unit and used in continuity about the posterior aspect of the heel 30 of a wearer's foot 28, or other foot portion. This can enhance conformance and fit about the area of the wearer's heel 30 and thereby compliment the stability provided by conventional heel counters. In some cases, this construction could render the use of a conventional heel counter unecessary. It can be readily understood that an alternate conformable device 20*n*, could also provide support to at least a portion of the plantar surface of a wearer's foot.

Figure 19:
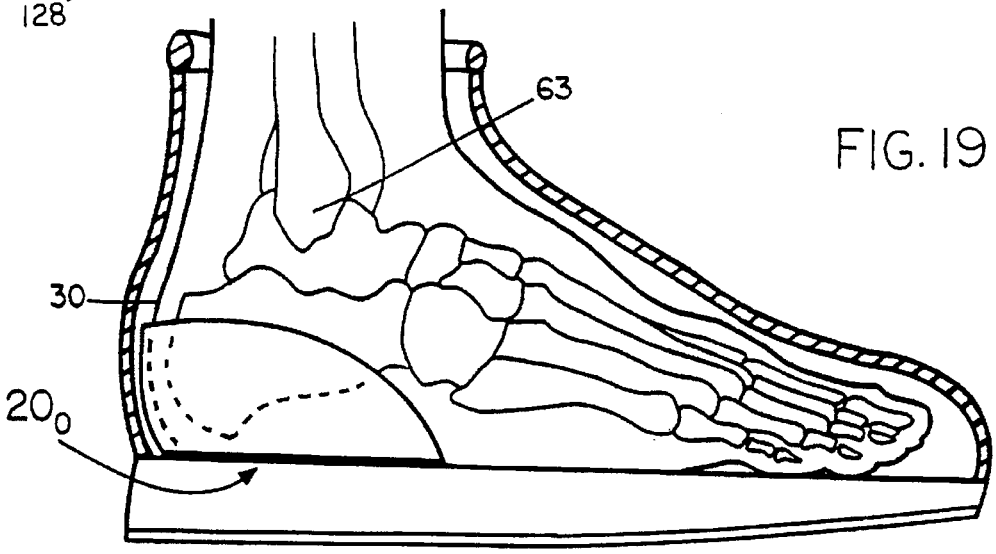
FIG. 19 is a lateral view of a conformable device for use substantially inferior to the lateral and medial malleolli and extending about the posterior of the wearer's heel.

As shown in FIG. 19, a conformable device 20*o* can be used in an area inferior to the lateral malleolus 63 and medial malleolus 65 in continuity about the posterior of a wearer's heel for enhancing conformance or fit, support and stability of the wearer's heel 30. It can be readily understood that an alternate conformable device 20*o* could provide support to at least a portion of the plantar surface of a wearer's foot.

Figure 20:
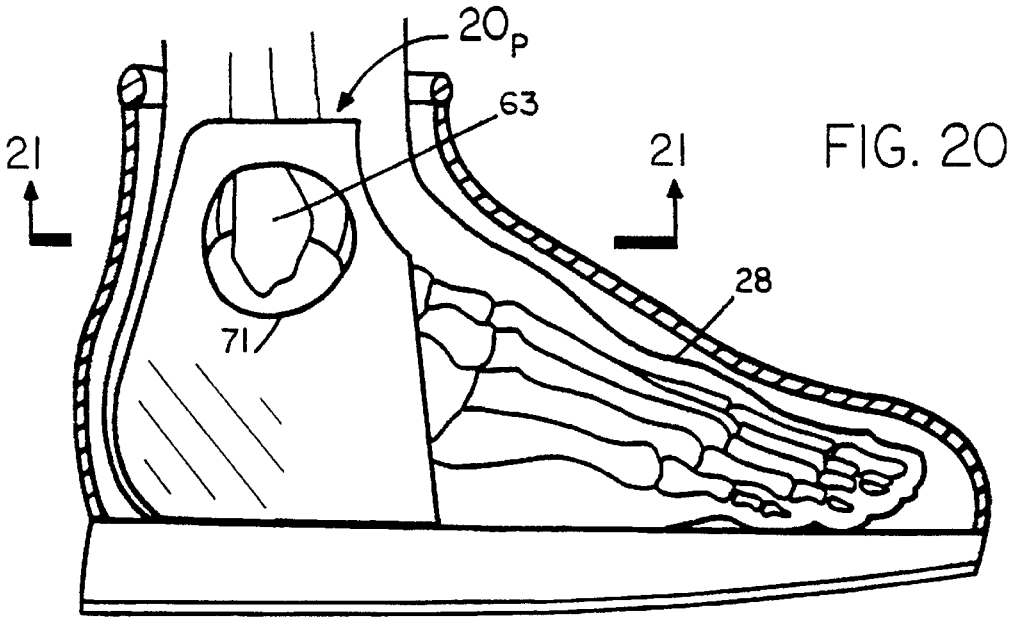
FIG. 20 is a lateral view of a conformable device showing an opening substantially encompassing the lateral malleolus.

As shown in FIG. 20, a conformable device 20*p* can form an opening 71 in the area about the lateral malleolus 63, and medial malleolus (not shown) for providing conformance or fit, support and stability while permitting plantar flexion and dorsi flexion of the wearer's foot 28. It can be readily understood that an alternate conformable device 20*p* could be formed in continuity about the posterior of a wearer's heel, and/or provide support to at least a portion of the plantar surface of a wearer's foot.

Figure 21:
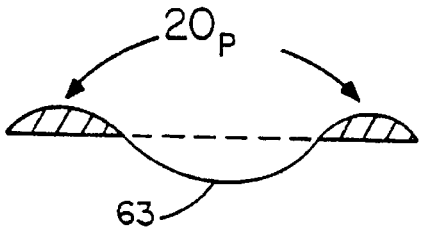
FIG. 21 is a cross-sectional view along the transverse plane of the conformable device of FIG. 20, along line 21—21.

As shown in FIG. 21, a cross-sectional view of the conformable device 20*p* of FIG. 20 along line 21—21 shows substantial encompassing of the lateral malleolus 63 by the conformable device 20*p*.

Shown in FIG. 22, is a lateral view of conformable device 20*q* which is suitable for use, e.g., with a footwear upper 72 for athletic shoes, skates, or as shown, ski boots. A notched area 75 in conformable device 20*q* shown about the distal and anterior aspect of the wearer's leg 76 and superior aspect of the foot 28 anterior to the lateral and medial malleolli permits plantar flexion and dorsi flexion of the foot 28. In particular, the notched area 75 relieves possible force applications that could otherwise be applied to substantially tendonous tissue, e.g., of the tibialis anterior, extensor digitorum longus, and extensor hallucis longus in the area about the superior and inferior extensor retinaculum(s) (not shown), and thereby cause possible restriction of a wearer's range of motion during plantar flexion and dorsi flexion. Also shown is the possible use of an access point 43 to a compartment 45 using VELCRO® 81 hook and pile closure means, thereby indicating that conformable device 20*q*, and the like, can be selectively removable. It can be readily understood that an alternate conformable device 20*q* could be formed in continuity about the posterior of a wearer's heel, and/or provide support to at least a portion of the plantar surface of a wearer's foot.

Figure 23:
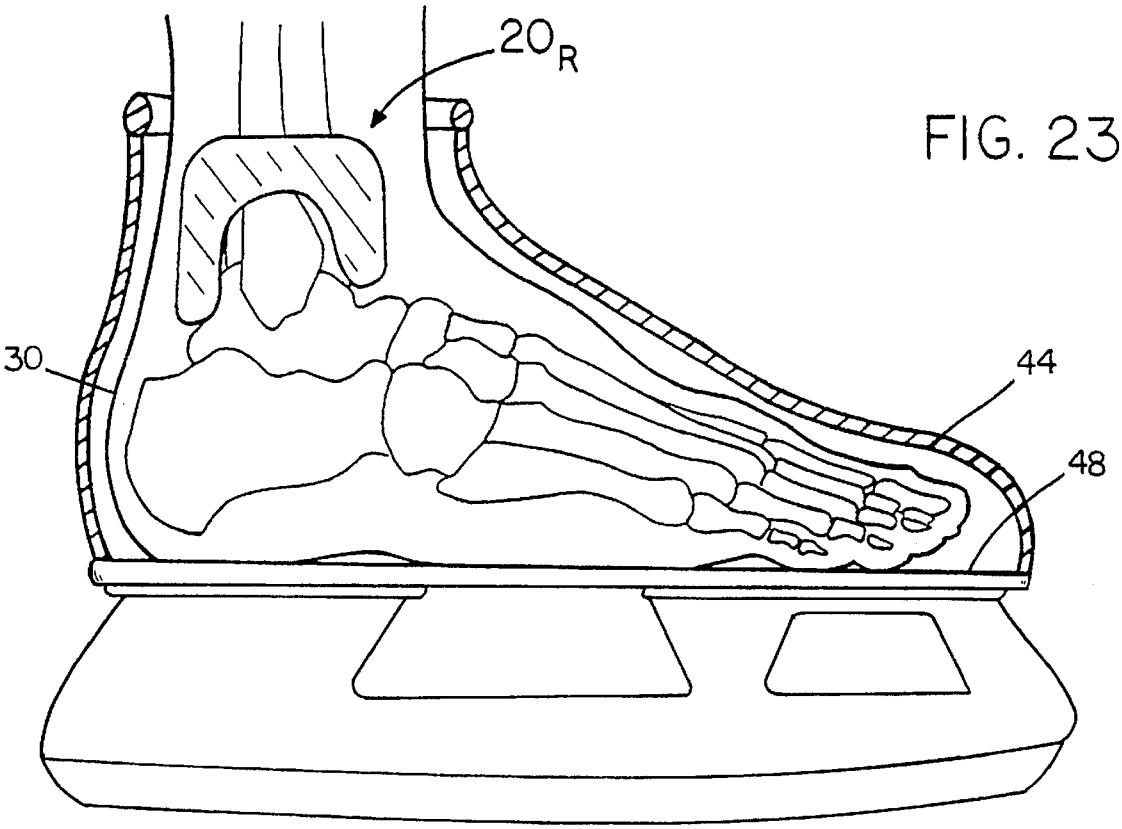
FIG. 23 is a lateral view of a conformable device having an inverted "U-shaped" configuration for conforming to and supporting the area of the lateral malleolus.

FIG. 23 is a lateral view of an inverted "U-shaped" conformable device 20*r* shown in functional relation to a hockey skate for conforming to and supporting the area about the lateral malleolus 63. It can be readily understood that a like conformable device could be utilized about the medial malleolus. Such a configuration can be used to help maintain the heel of the foot 28 in position on the footbed 48 in an article of footwear 44 during a demanding athletic activity such as skiing or skating.

Figure 24:
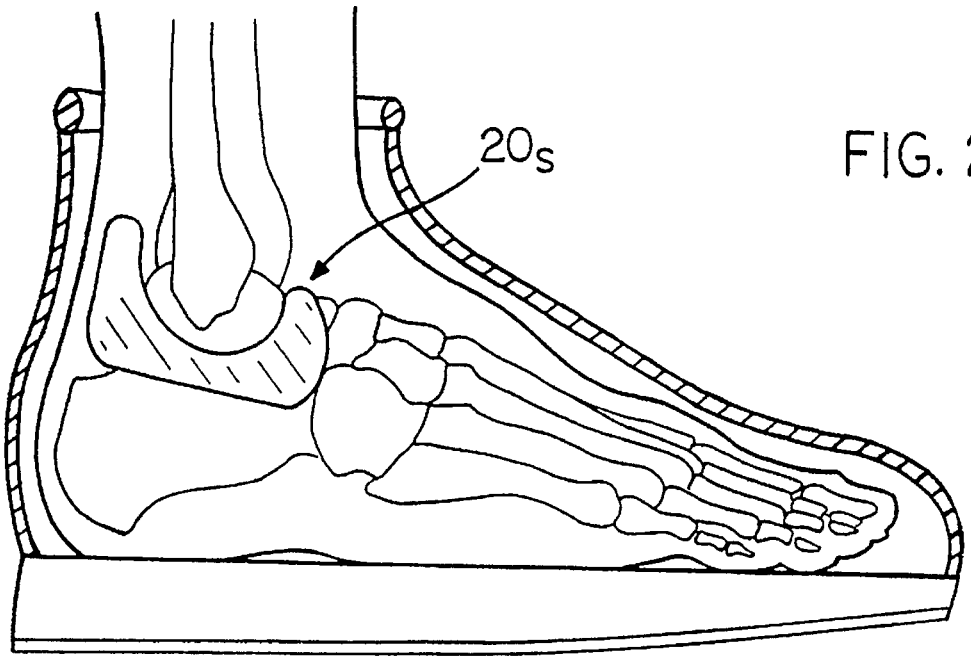
FIG. 24 is a lateral view of a conformable device having a "U-shaped" configuration for conforming to and supporting the area of the lateral malleolus.

FIG. 24 is a lateral view of a "U-shaped" conformable device 20*s* for conforming to and supporting the area about the lateral malleolus 63. It can be readily understood that a like conformable device could be utilized about the medial malleolus. Further, a conformable device resembling a combination of those disclosed in FIGS. 23 and 24 could be utilized which would pass in continuity about the posterior of a wearer's lower leg.

Figure 25:
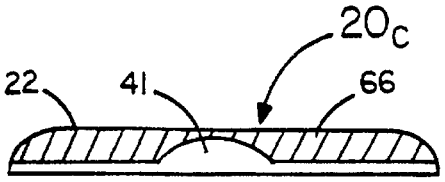
FIG. 25 is a cross-section view of conformable device 20*c* shown in FIG. 3, along line 25—25.

FIG. 25 is a cross-sectional view of conformable device 20*c* shown in FIG. 3 along line 25—25, showing foam material 66 having a relieved area for accomodating the plantar profile and mechanical protrusion of the plantar fascia during bodily movement. In this particular representation, a light cure material 41 characterized by lesser stiffness in compression relative to the foam material 66 is being used.

FIG. 26 is a representation of an alternate embodiment of a conformable device 20*dd* comprising an open-celled foam material 66 having cells 78 at least partially interpenetrated by a light cure material 41. In addition, it can be readily understood that other conformable solid matter including a light cure material can comprise an alternate conformable device. Moreover, it can be readily understood that a textile material can be impregnated or coated with a light cure material and be used, e.g., in a shoe upper, and subsequently be formed to a desired shape generally conforming to a portion of a wearer's anatomy and then be cured by a suitable light source to retain a permanent "memory" of the shape imparted thereto.

FIG. 27 shows a medially located appendage 50 including a preformed structural pattern 70 formed by selectively heat/pressure welding, bonding, or otherwise affixing opposing members of the pliable casing 22 using conventional means. The structural pattern 70 can form at least one opening 71 that will permit the ventilation of matter through conformable device 20*t*, and the like, in isolation from the inner volume of conformable device 20*t*. This can enable, e.g., evaporation of bodily fluids and thereby aid in heat dissipation, but also aid in subsequent washing and drying of an article of footwear 44. In addition, conformable device 20*t* is shown enclosed within a selectively removable barrier material 130 to visible and/or ultraviolet light for permitting storage of conformable device 20*t* in isolation from such light, thereby preventing premature exposure and permitting the light cure material 41 within conformable device 20*t* to be caused to set and cure when desired.

It can be readily understood that conformable device 20*t*, and the like, can be sealed or enclosed by a barrier material 130 to visible and ultraviolet light, e.g., a substantially light impermeable bag, envelope, or container as to have a relatively loose fit therein. However, it can be advantageous for conformable device 20*t*, and the like, to be sealed within a substantially form fitting barrier material 130 by conventional means, as shown in FIG. 27 with respect to conformable device 20*t*. Alternatively, a removable barrier material 130 to visible and ultraviolet light utilizing a pressure sensitive adhesive, or other conventional means can be used to expose a relatively light permeable portion of a conformable device.

In brief, relatively compact packaging constructions can permit the consumer to readily evaluate a conformable device in relation to an article of footwear prior to initiating the steps that will transform the substantially flowable or otherwise conformable light cure material into solid matter after a working or cure time. Such embodiments and associated methods enhance commercial viability within a retail environment.

FIG. 28 shows a cross-sectional view of a representation of a conformable device 20*aa* including an uncured light cure material 41 comprising liquid matter, and a void 40 containing a gas. It can be readily understood that at least one gas could be present in void 40, and such could possibly include a "supergas" as recited in the aforementioned patents to Rudy, and previously incorporated by reference herein.

Figure 29:
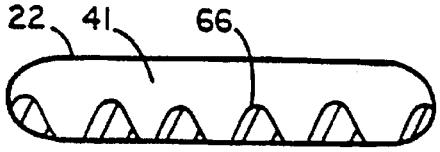
FIG. 29 is a cross-sectional view of a conformable device showing separated foam material members located on one side of a chamber and the presence of light cure material.

FIG. 29 shows a cross-sectional view of a representation of a conformable device showing separated members, e.g., rows, islands or peninsulas, and the like, of foam material 66 affixed to one side of a pliable casing 22 and the presence of light cure material 41 between separated members of foam material 66.

Figure 30:
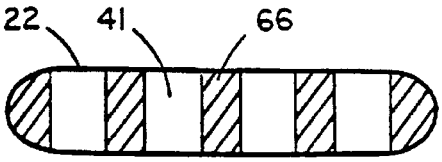
FIG. 30 is a cross-sectional view of a conformable device showing separated foam material members extending between and joining opposite sides of a chamber with light cure material being present between the foam material members.

FIG. 30 shows a cross-sectional view of a representation of a conformable device having foam material 66 members orientated approximately perpendicular to and in communication with opposing sides of pliable casing 22, thus permitting light cure material 41 to pass between such members.

Figure 31:
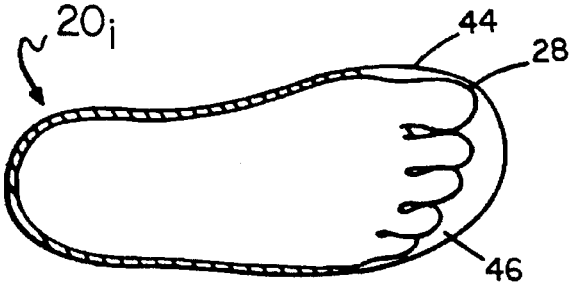
FIG. 31 is a top cross-sectional view along the transverse plane of a conformable device formed about the sides of a wearer's foot in an article of footwear.

FIG. 31 shows a top cross-sectional view taken along the transverse plane of a conformable device 20*i* showing substantial conformance or fit about at least a portion of the sides of a wearer's foot 28 in relation to an article of footwear 44.

FIG. 32 shows a cross-sectional view of a conformable device 20*bb* including an open-celled foam material 66 including a light cure material 41, and a void 40 containing a gas. It can be readily understood that at least one gas could be present in void 40, and such could possibly include a "supergas" as recited in the aforementioned patents to Rudy, previously incorporated by reference herein.

Figure 33:
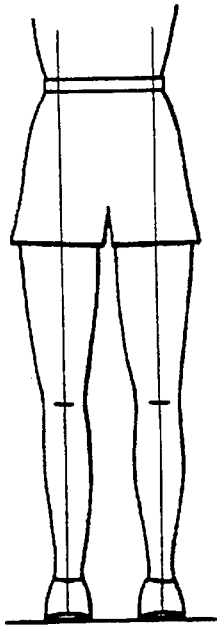
FIG. 33 is a front view of an individual showing proper bodily alignment in a standing neutral position.

FIG. 33 is an anterior view representation of a wearer of an article of footwear standing in or about the neutral position.

Figure 34:
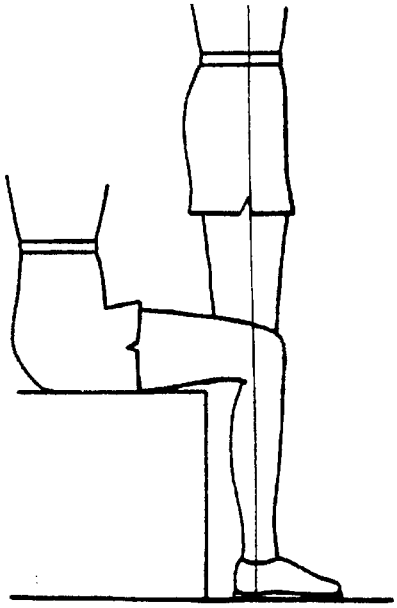
FIG. 34 is a side view of an individual demonstrating proper bodily alignment in standing and sitting neutral positions.

FIG. 34 is a side view representation of a wearer of an article of footwear standing or sitting in or about the neutral position.

Figure 35:
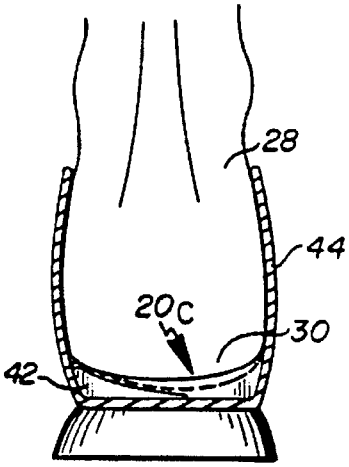
FIG. 35 is a cross-sectional posterior view of an article of footwear showing a corrective post or wedge in use with the conformable device of FIG. 3.

FIG. 35 is a rear cross-sectional view of an article of footwear 44 showing a corrective post or wedge 42 being used in conjunction with the conformable device 20*c* of FIG. 3, and showing a wearer's foot 28 in position. It is possible to introduce a corrective post or wedge 42, e.g., about the area of the wearer's heel 30, in conjunction with conformable device 20*c*, and the like, in order to rectify podiatric deviations that would fall outside the norm, e.g., potential and actual injurious conditions of eversion or pronation, inversion or supination, varus, and valgus. Further, the post or wedge 42 can be manufactured to specific degrees of correction for the article of footwear 44 in which the application is to be made. A protective backing 36 can be removed from the post or wedge 42 to expose a self-adhesive surface 38 for securing the post or wedge 42 in place. The introduction of such corrective devices should only be undertaken at the direction and with the supervision of a skilled and knowledgeable podiatrist, or other medical doctor.

When a conformable device is being used in connection with the efforts of a medical doctor to provide a prescription orthotic device, it can be advantageous for a wearer or user to remain relatively inactive while the light cure material is being caused to cure, and in particular, when a light cure material is being used which has been selected to have a relatively short working or cure time. It is generally advisable to form the conformable device with the wearer maintaining a standing position in order to better accommodate for flexion of the wearer's arches and general deformation of the foot. Whether the conformable device be formed in a standing or sitting position, the alignment of the wearer's leg and foot should generally correspond to the neutral position, i.e., the lower leg (tibia) should be in line with the heel (calcaneus), and both should be approximately perpendicular to the surface upon which the article of footwear rests. In a standing position, the knee and ankle joints should not be substantially flexed, and the alignment of the knee (patella) with respect to the foot should be such that it is roughly in line with the middle of the forefoot. The conditions of pronation or supination can thereby be limited or avoided. FIGS. 33 and 34 illustrate preferred standing and sitting neutral positions. However, when the making of an orthotic device is not the intended object, it can sometimes be advantageous that a wearer be moderately active through an anticipated range of motion as the light cure material is caused to set or cure in order to better accomodate for the dynamic movement of portions of a wearer's anatomy, e.g., protrusion of the plantar fascia.

As represented in FIG. 36, a conformable device 20*z* of the present invention, and the like, can be made visible from the bottom, sides, or top of an article of footwear 44 with the use of an opening 71, or transparent material 114, whether in partial or complete combination. This can serve to facilitate the transmission of suitable light energy to conformable device 20*z* in order to effect the cure of a light cure material 41. The use of color contrasting materials in the fabrication of an article of footwear 44 and conformable device 20*z*, and in particular, the use of a color contrasting foam material and light cure material 41 can result in visual confirmation of the conformance and support provided by the present invention.

As shown in FIG. 37, a conformable device 20*u* can be inserted in functional relation to the inner boot or liner 107 of an article of footwear. Various conventional means of affixing and positioning conformable device 20*u* can be used, including, but not limited to VELCRO® 81 hook and pile. In addition, the conformable device 20*u* can be positioned in a pocket or compartment 45 via an access point 43, as also shown with reference to conformable device 20*q* in FIG. 22. Obviously, the point of access and positioning of a pocket or compartment 45 would be a design choice within the scope of the present invention. When necessary, the inner boot or liner 107 is then inserted in an article of footwear which is then secured upon the wearer. Consonant with the procedures described herein, the conformable devices 20*q*, 20*u*, and the like, can then be caused to form in at least partial conformance about a portion of a wearer's anatomy and the light cure material contained therein be caused to cure.

FIG. 38 shows a conformable device 20*v* including a light cure material 41, a closed cell foam material 66 and a void 40 including a gas. In addition, a silicone gel material, or other foam of matter could be used in communication with the foam material (not shown). It can be readily understood that at least one gas can be present in void 40, and such could possibly include a "supergas" as recited in the aforementioned patents to Rudy previously incorporated by reference herein.

FIG. 39 shows a cross-sectional view of a conformable device 20*x* including a light cure material 41, and a void 40 including a gas comprising a portion of the midsole 21 of an article of footwear 44. A foam material 66 can be optionally included therein, as shown. A wearer's foot "bottoms out" and is substantially supported in an article of footwear 44 upon conformable device 20*x* without substantial quantities of light cure material 41 being present under the heel 30 or ball of the foot 28. The conformable device 20*x*, thereby serves to substantially fill the gap(s) between the foot 28 and the supporting surface(s) within the article of footwear 44. In particular, the conformable device 20*x* substantially forms about the plantar side of the foot 28 from an area about the heel 30 to an area about, but rearward of the metatarsal heads 25 and provides support to the area of the arches, but without adversely affecting the fit of the foot 28 in relation to the article of footwear 44. Alternatively, it can be readily understood that a conformable device could comprise a more substantial portion of the midsole of an article of footwear specifically designed to accomodate the same, and accordingly, a more substantial quantity of light cure material could then be present under the heel or ball of the foot. A suitable light cure material for use in such an embodiment would generally comprise a resilient elastomeric material.

A desired practical effect is to support and stabilize the wearer's rearfoot 37 during stance approximately about the neutral position in association with an article of footwear 44. The use of a light cure material 41 can then be understood as returning the foot to something resembling the natural environment wherein the structure and function of the foot evolved, i.e., substantial contact, support and at least partial plantar encapsulation upon an accommodative surface. This desired state is commonly lost when an article of footwear 44 with inadequate conforming properties is donned and worn, e.g., on a hard, flat surface such as asphalt or cement.

FIG. 40 shows a perspective view of a conformable device 20*w* having a pliable casing 22 comprising, at least in part, a selectively permeable material 110 which is readily permeable to gaseous matter, but substantially impermeable to liquid matter. Included in the inner volume of chamber 51 can be an open-celled foam material 66 which can be impregnated with an interpenetrating light cure material 41, or alternately and as represented, the open-celled foam material 66 can comprise an end product and be formed by a foamed or blown light cure material 41. Any gases produced by the foaming or blowing action can vent freely through a selectively permeable material 110 portion of pliable casing 22. The conformable device 20*w* can utilize a removable protective release material 36 having a self-adhesive surface 38 for exposing the selectively permeable material 110, or affixing the conformable device 20*w*, as desired.

When a conformable device 20*w* utilizes a selectively permeable material 110 to gases in at least of portion of the pliable casing 22, e.g., as shown in FIG. 40, it can be readily understood that a gas which serves as a blowing or foaming agent for light cure material 41 can escape from the inner volume of the chamber 51 of conformable device 20*w* through the permeable material 110 being used in at least a portion of pliable casing 22, whereas the substantial portion of light cure material 41 will remain substantially isolated within the inner volume of conformable device 20*w*.

FIG. 41 shows a cross-sectional view along line 41—41 of conformable device 20*x*, as shown in FIG. 39, and shows conformable device 20*x* at least partially encapsulated, or stock fitted in functional relation to the midsole 21 of an article of footwear 44. An opening 71 and/or the use of a transparent material 114 in the construction of the outsole 128 and/or midsole 21 can permit sufficient transmission of light for effecting cure of the light cure material 41.

Figure 42:
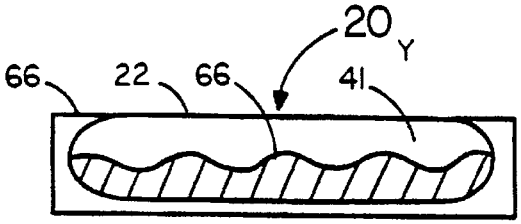
FIG. 42 is a cross-sectional view of a conformable device which is at least partially encapsulated in a foam material.

FIG. 42 shows a conformable device 20*y* at least partially encapsulated in a foam material 66 forming a generally planar superior surface. It can be readily understood that a conformable device can be at least partially encapsulated in a foam material, or other form of matter.

Figure 43:
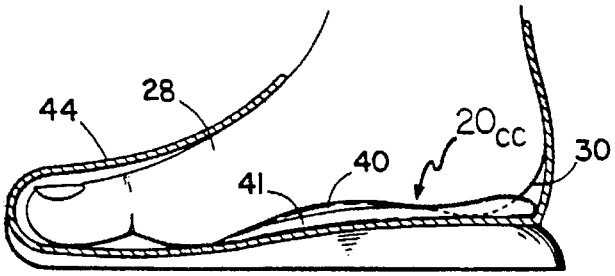
FIG. 43 is a medial side view of a conformable device including light cure material and a void filled with a gas, generally similar to that shown in cross-section in FIG. 28, positioned in an article of footwear.

FIG. 43 shows a medial view of a conformable device 20*cc*, generally similar to conformable device 20*aa* shown in cross section in FIG. 28, positioned in an article of footwear 44 with parts broken away to show the foot 28 in position. Conformable device 20*cc* includes a light cure material 41 and a void 40 including a gas. Generally, an enclosed gas will assume a superior position within the inner volume of conformable device 20*cc* adjacent the wearer's foot 28.

FIG. 44 shows in cross section a general representation of a light table 120 including a man-made light source 113 and a substantially transparent platform 112, e.g., comprised of glass, PLEXIGLAS®, acrylic material, and the like. It can be advantageous to use a fluorescent light source 113 as such operate at relatively low temperatures and are energy efficient. A power cord 129 including a plug 125 is attached to the light source 113. Not shown is the possible use of conventional power switch(es), a fan for possibly cooling the light table, and ventilation holes. Power switches which are activated by contact, sound, or motion can also be used as desired. Further, an wearer's foot 28 is shown in relation to conformable device 20*c*. Reference is made to suitable standing and sitting positions, as shown in FIGS. 33 and 34. The light source 113 can provide suitable visible or ultraviolet light, as desired, to cause the light cure material 41 associated with conformable device 20*c*, and the like, to be caused to set and cure in conformance with a portion of the wearer's anatomy. If and when desired, this can also be accomplished in functional relation to an article of footwear, as described herein.

FIG. 45 shows a cross sectional side view of an electroluminescent lamp 122 positioned adjacent a conformable device 20*c* shown in relation to an article of footwear 44. The electroluminescent lamp 122 can be powered with the use of a DC battery 123 and suitable invertor 124, or alternately, by AC current with the use of a suitable transformer (not shown), power cord 129 and plug, and as desired, selectively attachable electrical connections 127. Further, a electroluminescant lamp 122, and/or a DC battery and invertor, can be permanently positioned within an article of footwear (not shown). However, it is generally more cost effective to use a remote electrical power source that can be attached as desired via selectively attachable electrical connections 127, and further, a removable electroluminescent lamp 122. Electroluminescent lamp 122 can comprise a suitable light source for causing light cure material 41 to set and cure in conformance with a portion of a wearer's anatomy in the interior of an article of footwear 44.

FIG. 46 shows a cross sectional side view of a fiber optic material 126, e.g., strands or ribbon, positioned adjacent a conformable device 20*c*, shown in FIG. 3, that is positioned in relation to an article of footwear 44. The fiber optic material 126 is exposed on the exterior of the article of footwear 44 and can thereby be placed in communication with a suitable light source, whereby light can be conducted into the interior of the article of footwear 44 adjacent conformable device 20*c*, and the like. The fiber optic material 126 in the area adjacent conformable device 20*c* can place the light cure material 41 contained therein in communication with visible or ultraviolet light, as desired, and thereby cause the light cure material 41 to set and cure in conformance with a portion of a wearer's anatomy in the interior of an article of footwear 44. It can be readily understood that suitable light and power sources can be used as desired, e.g., a piezoelectric power source can be included within an article of footwear, to cause the light cure material 41 to cure with the use of fiber optic material 126, as desired. It can be readily understood that other light conductive materials can be utilized for exposing a conformable device to suitable a light source for effecting cure of a light cure material within an article of footwear.

FIG. 47 shows a cross sectional side view of a substantially transparent mold 131, e.g., comprising glass, PLEXIGLASS®, acrylic material, and the like, and containing a light cure material 41. Further, also shown is a light source 113 and the possible use of a reflective material 111 on at least one side of the mold 131, as desired. It can be readily understood that a suitable light source 113 could comprise a multiplicity of lamps, and such could be arranged as to partially or completely encompass or encircle the mold 131, as desired, when the mold 131 is positioned as desired therein, or alternately, as mold 131 is caused to pass in proximity to the lamps at a desired rate of speed. The visible or ultraviolet light emitted by the light source(s) 113 can cause the light cure material 41 contained within the mold 131 to set and cure. Further, the light cure material 41 can be foamed or blown, as possibly desired, using conventional means known in the art. Moreover, it can be readily understood that a conformable device including a light cure material, a gas, foam material, or other form of matter in partial or complete combination, as desired, can be positioned within a mold and thereby be caused to form in a desired shape when the light cure material is caused to set and cure.

ALTERNATE/EQUIVALENT EMBODIMENTS

It can be readily understood that a chamber can be alternately formed by a material which serves to substantially enclose and thereby define the inner volume of a conformable device without the necessary presence of pliable casing, e.g., a three dimensional mold. Moreover, a light cure material can comprise a usable conformable device in some instances without the need for a pliable casing, e.g., as represented in FIG. 1, a sheet or blank comprising a conformable light cure material 41, can be caused to set and cure in functional relation to a wearer of an article of footwear to comprise a conformable device 20*a*.

In addition, it can be readily understood that in an alternate embodiment of the present invention the light-cure material including any other matter contained within the inner volume of a conformable device can be removed from the pliable casing after the conformable device has been formed in at least partial conformance to a wearer and subsequently used in an article of footwear.

Moreover, alternate embodiments of a conformable device, can comprise a plurality of chambers which are in continuous fluid communication, or a plurality of individual chambers. In addition, different individual chambers within a conformable device can contain different light cure materials or other material components and can thereby exhibit different physical and mechanical properties. Different chambers having different form and/or inner volume containing like material components can also exhibit different physical and mechanical properties. Obviously, an article of footwear can employ a plurality of conformable device(s).

Further, in a further alternate embodiment, a foam material or textile material which is impregnated or coated with a light cure material can comprise a conformable device.

However, it can be advantageous to contain some light cure materials in a pliable casing in relative isolation from atmospheric gases, and more specifically oxygen, which can inhibit some light cure materials. In addition, it is advantageous that a conformable device be specifically designed for the article of footwear in which the application is to be made. A suitable conformable device can then vary in design, configuration and dimensions depending upon the particular application.

For the sake of clarity, various preferred embodiments of the present invention disclosed herein and features thereof have been largely treated independently. However, it can be readily understood that alternate embodiments of the present invention for use with articles of footwear can include a plurality, or various combinations of the features and embodiments disclosed herein.

In addition, it is recognized that various terms are commonly used, and sometimes interchangeably, to describe changes in the physical state of various light cure materials, e.g., tack time, skin time, pot life, tooling time, working time, setting time, partial and complete cure times. Such terms should not be used or interpreted in such a manner as to compromise the scope of the present invention.

It can be appreciated that various alternate embodiments of a conformable device provide a relatively simple, but effective means for enhancing the conformance or fit, support, stability, comfort, and cushioning qualities of articles of footwear. The various embodiments described herein anticipate a wide range of possible applications and the need to accommodate individual differences across a broad population of the general public.

Further, it can be readily understood that the present invention anticipates the use of conformable devices by users of various articles of protective and athletic equipment, or other devices and objects. For example, the use of shin guards, knee pads, thigh pads, hip pads, rib guards, shoulder pads, elbow pads, neck guards, face guards, protective hand and forearm equipment and helmets is prevalent in a large number of contact and non-contact sports, such as football, hockey, baseball, soccer, and volleyball. Protective helmets and knee pads are also used in the construction industry, and helmets of various kinds enjoy wide use in the military and in the field of transportation, e.g., bicycle and motorcycle operation. Suitable conformable devices could also be used to advantage with various prosthetic devices, and seats.

While the above detailed description of the invention contains many specificities, these should not be construed as limitations on the scope of the invention, but rather as exemplifications of several preferred embodiments thereof. Many other variations are possible. Accordingly, the scope of the invention should be determined not by the embodiments discussed or illustrated, but by the appended claims and their legal equivalents.

What is claimed is:

1. A method for making a conformable device for use with an article of footwear, said method comprising the steps of:

a) placing a conformable device including a light cure material which is capable of being cured when exposed to light comprising a wavelength between 280–750 nanometers upon a platform of a light table which is capable of providing said light, said light table comprising a light source positioned in functional relation thereto which is capable of irradiating at least a substantial inferior portion of said conformable device when said conformable device is positioned under a wearer's foot when weight bearing upon said platform;

b) placing the foot of said wearer upon said conformable device, thereby causing a force application to be made thereupon and causing at least a portion of said conformable device to be formed in conformance with at least a portion of said foot; and c) activating said light source to cause the cure of said light cure material, thereby causing the shape imparted to the conformable device to be substantially retained.

2. The method recited in claim 1, wherein said light having a wavelength substantially between 280 and 750 nanometers substantially comprises ultraviolet light.

3. The method recited in claim 1, wherein said light having a wavelength substantially between 280 and 750 nanometers substantially comprises visible light.

4. The method recited in claim 1, comprising the further step of:

d) removing a selectively removable barrier material with respect to said light from about said conformable device prior to placing said conformable device upon said platform.

5. The method recited in claim 1, comprising the further step of:

d) placing said foot in approximately a neutral position prior to causing said light cure material to cure, and retaining said foot in said neutral position while causing said light cure material to cure.

6. The method recited in claim 1, wherein said platform comprises a substantially transparent material which is capable of transmitting said light from said light source.

7. A method for making a conformable device for use with an article of footwear, said method comprising the steps of:

a) placing a conformable device including a light cure material which is capable of being cured when exposed to light comprising a wavelength between 280–750 nanometers within an article of footwear which is capable of transmitting said light to said conformable device;

b) placing a foot of a wearer into said article of footwear in functional relation to said conformable device thereby causing a force application to be made thereupon and causing at least a portion of said conformable device to be formed in conformance with at least a portion of said foot;

c) positioning said article of footwear including said conformable device and the foot of said wearer upon a platform of a light table which is capable of providing said light, said light table comprising a light source positioned in functional relation thereto which is capable of irradiating at least a substantial inferior portion of said conformable device when said conformable device is positioned under said wearer's foot within said article of footwear when weight bearing upon said platform; and, d) activating said light source to cause the cure of said light cure material, thereby causing the shape imparted to the conformable device to be substantially retained.

8. The method recited in claim 7, wherein said light having a wavelength substantially between 280 and 750 nanometers substantially comprises ultraviolet light.

9. The method recited in claim 7, wherein said light having a wavelength substantially between 280 and 750 nanometers substantially comprises visible light.

10. The method recited in claim 7, comprising the further step of:

d) removing a selectively removable barrier material with respect to said light from about said conformable device prior to placing said conformable device within said article of footwear.

11. The method recited in claim 7, comprising the further step of:

d) placing said foot in approximately a neutral position prior to causing said light cure material to cure, and retaining said foot in said neutral position while causing said light cure material to cure.

12. The method recited in claim 7, wherein said platform comprises a substantially transparent material which is capable of transmitting said light from said light source.

13. A method for making a conformable device for use with an article of footwear, said method comprising the steps in the following order:

a) placing a conformable device comprising a light cure material which is capable of being cured when exposed to light comprising a wavelength between 280–750 nanometers within an article of footwear which is capable of transmitting said light to a substantial portion of said conformable device;

b) placing a foot of said wearer in functional relation to said conformable device, thereby causing a force application to be made thereupon and causing at least a portion of said conformable device to be formed in conformance with at least a portion of said foot; and c) exposing said article of footwear including said conformable device to said light to cause the cure of said light cure material, thereby causing the shape imparted to the conformable device to be substantially retained.

14. The method recited in claim 13, wherein said light having a wavelength substantially between 280 and 750 nanometers substantially comprises ultraviolet light.

15. The method recited in claim 13, wherein said light having a wavelength substantially between 280 and 750 nanometers substantially comprises visible light.

16. The method recited in claim 13, comprising the further step of:

d) removing a selectively removable barrier material with respect to said light from about said conformable device prior to placing said conformable device within said article of footwear.

17. The method recited in claim 13, comprising the further step of:

d) placing said foot in approximately a neutral position prior to causing said light cure material to cure, and retaining said foot in said neutral position while causing said light cure material to cure.

18. The method recited in claim 13, said article of footwear comprising an opening for transmitting light to said conformable device including said light cure material, when said light is transmitted through said opening.

19. The method recited in claim 13, said article of footwear comprising a substantially transparent material for transmitting said light to said conformable device including said light cure material, wherein said light is transmitted through said substantially transparent material.

20. The method recited in claim 13, said article of footwear comprising means for transmitting said light to at least an inferior portion of said conformable device including said light cure material, whereby said light cure material can be caused to cure.

* * * * *